US009794718B2

(12) United States Patent
Crockett et al.

(10) Patent No.: US 9,794,718 B2
(45) **Date of Patent: *Oct. 17, 2017**

(54) REFLECTED SOUND RENDERING FOR OBJECT-BASED AUDIO

(71) Applicant: Dolby Laboratories Licensing Corporation, San Francisco, CA (US)

(72) Inventors: Brett G. Crockett, Brisbane, CA (US); Spencer Hooks, San Mateo, CA (US); Alan Seefeldt, San Francisco, CA (US); Joshua B. Lando, San Francisco, CA (US); C. Phillip Brown, Castro Valley, CA (US); Sripal S. Mehta, San Francisco, CA (US); Stewart Murrie, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 107 days.

This patent is subject to a terminal disclaimer.

(21) Appl. No.: 14/421,768

(22) PCT Filed: Aug. 28, 2013

(86) PCT No.: PCT/US2013/056989

§ 371 (c)(1),
(2) Date: Feb. 13, 2015

(87) PCT Pub. No.: WO2014/036085

PCT Pub. Date: Mar. 6, 2014

(65) Prior Publication Data

US 2015/0350804 A1 Dec. 3, 2015

Related U.S. Application Data

(60) Provisional application No. 61/695,893, filed on Aug. 31, 2012.

(51) Int. Cl.
*H04S 7/00* (2006.01)
*H04S 5/00* (2006.01)
(Continued)

(52) U.S. Cl.
CPC ..... *H04S 7/301* (2013.01); *H04R 5/02* (2013.01); *H04R 5/04* (2013.01); *H04S 3/008* (2013.01);
(Continued)

(58) Field of Classification Search
None
See application file for complete search history.

(56) References Cited

U.S. PATENT DOCUMENTS 4,890,689 A * 1/1990 Smith ..... H04R 1/403 181/144
7,751,915 B2 7/2010 Roeder
(Continued)

FOREIGN PATENT DOCUMENTS

CN 1658709 8/2005
CN 102318372 1/2012
(Continued)

OTHER PUBLICATIONS

Stanojevic, T. et al "The Total Surround Sound System", 86th AES Convention, Hamburg, Mar. 7-10, 1989.
(Continued)

*Primary Examiner* — Curtis Kuntz
*Assistant Examiner* — Qin Zhu

(57) ABSTRACT

Embodiments are described for rendering spatial audio content through a system that is configured to reflect audio off of one or more surfaces of a listening environment. The system includes an array of audio drivers distributed around a room, wherein at least one driver of the array of drivers is configured to project sound waves toward one or more
(Continued)

surfaces of the listening environment for reflection to a listening area within the listening environment and a renderer configured to receive and process audio streams and one or more metadata sets that are associated with each of the audio streams and that specify a playback location in the listening environment.

10 Claims, 15 Drawing Sheets

(51) Int. Cl.
*H04R 5/04* (2006.01)
*H04S 3/00* (2006.01)
*H04R 5/02* (2006.01)

(52) U.S. Cl.
CPC ..... *H04S 5/005* (2013.01); *H04S 7/30* (2013.01); *H04R 2205/024* (2013.01); *H04S 2400/01* (2013.01); *H04S 2400/11* (2013.01); *H04S 2420/01* (2013.01); *H04S 2420/03* (2013.01)

(56) References Cited

U.S. PATENT DOCUMENTS

| | | | | |
|---|---|---|---|---|
| 2004/0247140 | A1* | 12/2004 | Norris | G10H 1/0091 381/77 |
| 2005/0177256 | A1* | 8/2005 | Shintani | H04R 27/00 700/94 |
| 2007/0263888 | A1 | 11/2007 | Melanson | |
| 2007/0263890 | A1 | 11/2007 | Melanson | |
| 2008/0232603 | A1* | 9/2008 | Soulodre | G01H 7/00 381/63 |
| 2010/0014692 | A1* | 1/2010 | Schreiner | H04S 3/008 381/119 |
| 2012/0008789 | A1 | 1/2012 | Kim | |
| 2012/0183162 | A1 | 7/2012 | Chabanne | |
| 2014/0133683 | A1 | 5/2014 | Robinson | |

FOREIGN PATENT DOCUMENTS

| | | |
|---|---|---|
| CN | 102440003 | 5/2012 |
| DE | 2941692 | 4/1981 |
| DE | 3201455 | 7/1983 |
| EP | 1416769 | 5/2004 |
| EP | 1971187 | 9/2008 |
| JP | 2002-199487 | 7/2002 |
| JP | 2009-017137 | 1/2009 |
| JP | 2010-258653 | 11/2010 |
| JP | 2011-066544 | 3/2011 |
| RS | 1332 U | 8/2013 |
| WO | 2009/022278 | 2/2009 |
| WO | 2011/135283 | 11/2011 |

OTHER PUBLICATIONS

Stanojevic, T. et al "Designing of TSS Halls" 13th International Congress on Acoustics, Yugoslavia, 1989.
Stanojevic, T. et al "TSS System and Live Performance Sound" 88th AES Convention, Montreux, Mar. 13-16, 1990.
Stanojevic, Tomislav "3-D Sound in Future HDTV Projection Systems" presented at the 132nd SMPTE Technical Conference, Jacob K. Javits Convention Center, New York City, Oct. 13-17, 1990.
Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.
Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.
Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.
Stanojevic, T. et al "The Total Surround Sound (TSS) Processor" SMPTE Journal, Nov. 1994.
Stanojevic, Tomislav "Surround Sound for a New Generation of Theaters, Sound and Video Contractor" Dec. 20, 1995.

* cited by examiner

1500

| Metadata Type | Metadata Elements |
|---|---|
| Audio Content Type | Dialog/music/ambient/effects<br>Direct/Diffuse/Reflected |
| Driver Definitions | Number of Drivers<br>Acoustic Characteristics<br>Position of Drivers<br>Angle of Drivers |
| Control Signals | Active Steering<br>Active Tuning |
| Calibration Information | Sensor type and location<br>Room Size<br>Ambient Charactoristics<br>Imaging information<br>Speaker Locations<br>Speaker Locations |

FIG. 15

1600

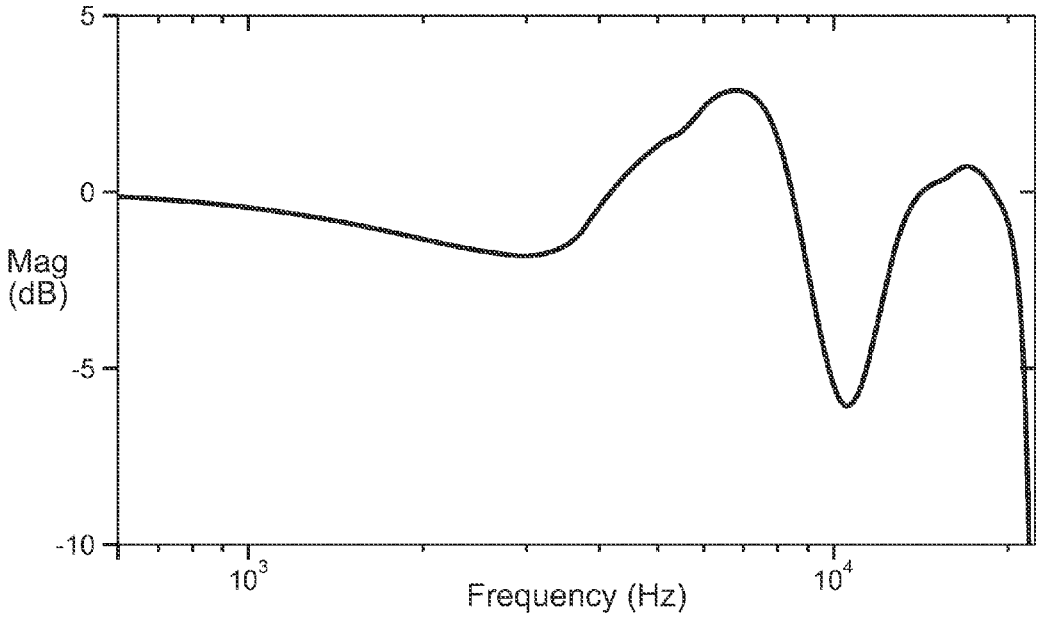

FIG. 16

REFLECTED SOUND RENDERING FOR OBJECT-BASED AUDIO

CROSS-REFERENCE TO RELATED APPLICATIONS

This application claims the benefit of priority to U.S. Provisional Patent Application No. 61/695,893 filed on 31 Aug. 2012, hereby incorporated by reference in its entirety.

FIELD OF THE INVENTION

One or more implementations relate generally to audio signal processing, and more specifically to rendering adaptive audio content through direct and reflected drivers in certain listening environments.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Cinema sound tracks usually comprise many different sound elements corresponding to images on the screen, dialog, noises, and sound effects that emanate from different places on the screen and combine with background music and ambient effects to create the overall audience experience. Accurate playback requires that sounds be reproduced in a way that corresponds as closely as possible to what is shown on screen with respect to sound source position, intensity, movement, and depth. Traditional channel-based audio systems send audio content in the form of speaker feeds to individual speakers in a playback environment. The introduction of digital cinema has created new standards for cinema sound, such as the incorporation of multiple channels of audio to allow for greater creativity for content creators, and a more enveloping and realistic auditory experience for audiences. Expanding beyond traditional speaker feeds and channel-based audio as a means for distributing spatial audio is critical, and there has been considerable interest in a model-based audio description that allows the listener to select a desired playback configuration with the audio rendered specifically for their chosen configuration. To further improve the listener experience, playback of sound in true three-dimensional (3D) or virtual 3D environments has become an area of increased research and development. The spatial presentation of sound utilizes audio objects, which are audio signals with associated parametric source descriptions of apparent source position (e.g., 3D coordinates), apparent source width, and other parameters. Object-based audio may be used for many multimedia applications, such as digital movies, video games, simulators, and is of particular importance in a home environment where the number of speakers and their placement is generally limited or constrained by the confines of a relatively small listening environment.

Various technologies have been developed to improve sound systems in cinema environments and to more accurately capture and reproduce the creator's artistic intent for a motion picture sound track. For example, a next generation spatial audio (also referred to as "adaptive audio") format has been developed that comprises a mix of audio objects and traditional channel-based speaker feeds along with positional metadata for the audio objects. In a spatial audio decoder, the channels are sent directly to their associated speakers (if the appropriate speakers exist) or down-mixed to an existing speaker set, and audio objects are rendered by the decoder in a flexible manner. The parametric source description associated with each object, such as a positional trajectory in 3D space, is taken as an input along with the number and position of speakers connected to the decoder. The renderer then utilizes certain algorithms, such as a panning law, to distribute the audio associated with each object across the attached set of speakers. This way, the authored spatial intent of each object is optimally presented over the specific speaker configuration that is present in the listening environment.

Current spatial audio systems have generally been developed for cinema use, and thus involve deployment in large rooms and the use of relatively expensive equipment, including arrays of multiple speakers distributed around the listening environment. An increasing amount of cinema content that is presently being produced is being made available for playback in the home environment through streaming technology and advanced media technology, such as blu-ray, and so on. In addition, emerging technologies such as 3D television and advanced computer games and simulators are encouraging the use of relatively sophisticated equipment, such as large-screen monitors, surround-sound receivers and speaker arrays in home and other listening (non-cinema/theater) environments. However, equipment cost, installation complexity, and room size are realistic constraints that prevent the full exploitation of spatial audio in most home environments. For example, advanced object-based audio systems typically employ overhead or height speakers to playback sound that is intended to originate above a listener's head. In many cases, and especially in the home environment, such height speakers may not be available. In this case, the height information is lost if such sound objects are played only through floor or wall-mounted speakers.

What is needed therefore is a system that allows full spatial information of an adaptive audio system to be reproduced in a listening environment that may include only a portion of the full speaker array intended for playback, such as limited or no overhead speakers, and that can utilize reflected speakers for emanating sound from places where direct speakers may not exist.

BRIEF SUMMARY OF EMBODIMENTS

Systems and methods are described for an audio format and system that includes updated content creation tools, distribution methods and an enhanced user experience based on an adaptive audio system that includes new speaker and channel configurations, as well as a new spatial description format made possible by a suite of advanced content creation tools created for cinema sound mixers. Embodiments include a system that expands the cinema-based adaptive audio concept to a particular audio playback ecosystem including home theater (e.g., A/V receiver, soundbar, and blu-ray player), E-media (e.g., PC, tablet, mobile device, and headphone playback), broadcast (e.g., TV and set-top box), music, gaming, live sound, user generated content ("UGC"), and so on. The home environment system includes components that provide compatibility with the theatrical content, and features metadata definitions that include content creation information to convey creative intent, media intelligence information regarding audio objects, speaker feeds, spatial rendering information and content dependent metadata that indicate content type such as dialog, music, ambience, and so on. The adaptive audio definitions may include standard speaker feeds via audio channels plus audio objects with associated spatial rendering information (such as size, velocity and location in three-dimensional space). A novel speaker layout (or channel configuration) and an accompanying new spatial description format that will support multiple rendering technologies are also described. Audio streams (generally including channels and objects) are transmitted along with metadata that describes the content creator's or sound mixer's intent, including desired position of the audio stream. The position can be expressed as a named channel (from within the predefined channel configuration) or as 3D spatial position information. This channels plus objects format provides the best of both channel-based and model-based audio scene description methods.

Embodiments are specifically directed to a system for rendering sound using reflected sound elements comprising an array of audio drivers for distribution around a listening environment, wherein some of the drivers are direct drivers and others are reflected drivers that are configured to project sound waves toward one or more surfaces of the listening environment for reflection to a specific listening area; a renderer for processing audio streams and one or more metadata sets that are associated with each audio stream and that specify a playback location in the listening environment of a respective audio stream, wherein the audio streams comprise one or more reflected audio streams and one or more direct audio streams; and a playback system for rendering the audio streams to the array of audio drivers in accordance with the one or more metadata sets, and wherein the one or more reflected audio streams are transmitted to the reflected audio drivers.

INCORPORATION BY REFERENCE

Any publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

FIG. 15 is a table illustrating certain metadata definitions for use in an adaptive audio system utilizing a reflected sound renderer for listening environments, under an embodiment.

FIG. 16 is a graph that illustrates the frequency response for a combined filter, under an embodiment.

DETAILED DESCRIPTION OF THE INVENTION

Figure 1:
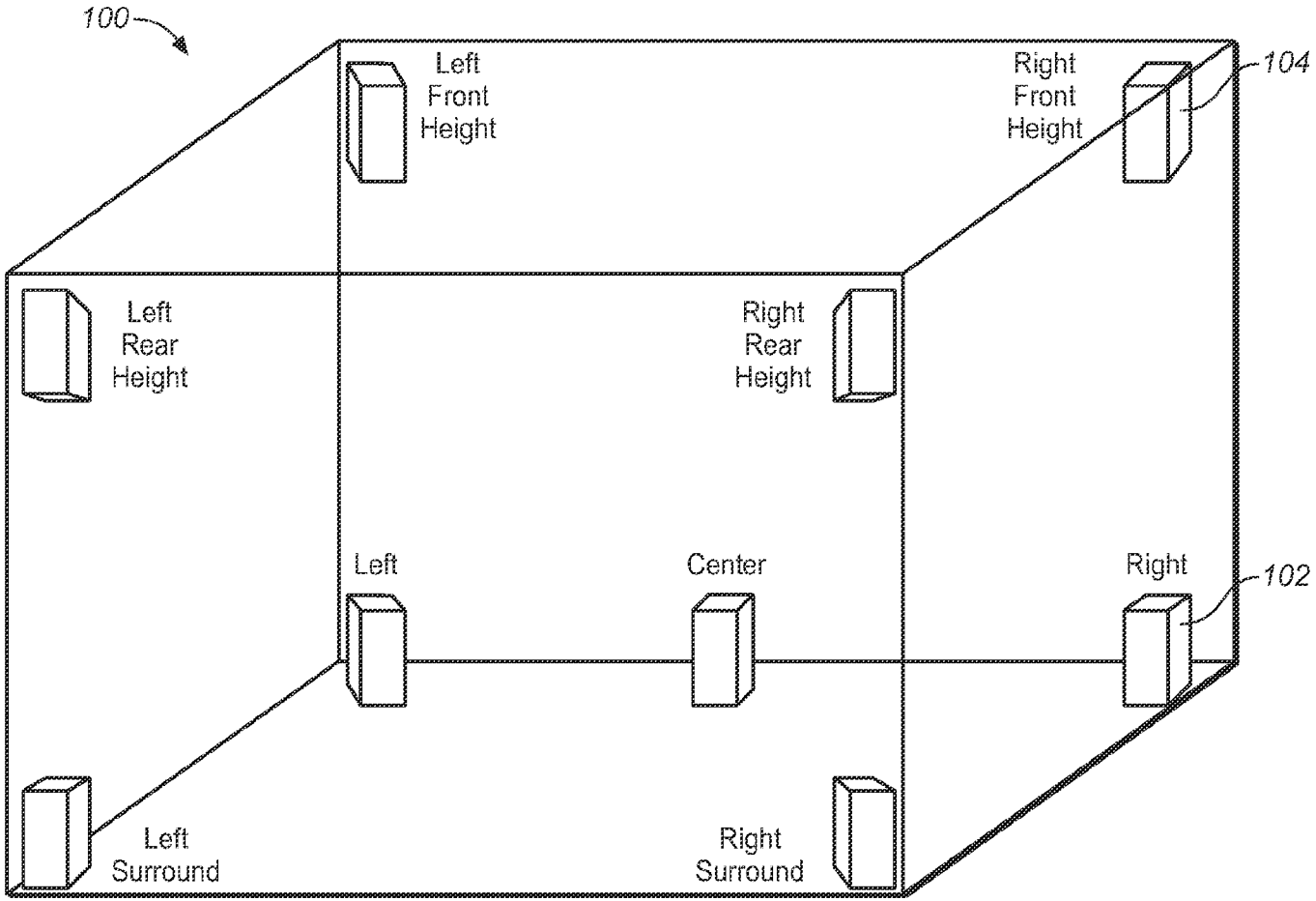
FIG. 1 illustrates an example speaker placement in a surround system (e.g., 9.1 surround) that provides height speakers for playback of height channels.

Systems and methods are described for an adaptive audio system that renders reflected sound for adaptive audio systems that lack overhead speakers. Aspects of the one or more embodiments described herein may be implemented in an audio or audio-visual system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on; the term "object" or "object-based audio" means one or more audio channels with a parametric source description, such as apparent source position (e.g., 3D coordinates), apparent source width, etc.; and "adaptive audio" means channel-based and/or object-based audio signals plus metadata that renders the audio signals based on the playback environment using an audio stream plus metadata in which the position is coded as a 3D position in space; and "listening environment" means any open, partially enclosed, or fully enclosed area, such as a room that can be used for playback of audio content alone or with video or other content, and can be embodied in a home, cinema, theater, auditorium, studio, game console, and the like. Such an area may have one or more surfaces disposed therein, such as walls or baffles that can directly or diffusely reflect sound waves.

Adaptive Audio Format and System

Embodiments are directed to a reflected sound rendering system that is configured to work with a sound format and processing system that may be referred to as a "spatial audio system" or "adaptive audio system" that is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio elements and audio object coding elements. Such a combined approach provides greater coding efficiency and rendering flexibility compared to either channel-based or object-based approaches taken separately. An example of an adaptive audio system that may be used in conjunction with present embodiments is described in pending U.S. Provisional Patent Application 61/636,429, filed on Apr. 20, 2012 and entitled "System and Method for Adaptive Audio Signal Generation, Coding and Rendering," which is hereby incorporated by reference in its entirety.

An example implementation of an adaptive audio system and associated audio format is the Dolby® Atmos™ platform. Such a system incorporates a height (up/down) dimension that may be implemented as a 9.1 surround system, or similar surround sound configuration. FIG. 1 illustrates the speaker placement in a present surround system (e.g., 9.1 surround) that provides height speakers for playback of height channels. The speaker configuration of the 9.1 system 100 is composed of five speakers 102 in the floor plane and four speakers 104 in the height plane. In general, these speakers may be used to produce sound that is designed to emanate from any position more or less accurately within the listening environment. Predefined speaker configurations, such as those shown in FIG. 1, can naturally limit the ability to accurately represent the position of a given sound source. For example, a sound source cannot be panned further left than the left speaker itself. This applies to every speaker, therefore forming a one-dimensional (e.g., left-right), two-dimensional (e.g., front-back), or three-dimensional (e.g., left-right, front-back, up-down) geometric shape, in which the downmix is constrained. Various different speaker configurations and types may be used in such a speaker configuration. For example, certain enhanced audio systems may use speakers in a 9.1, 11.1, 13.1, 19.4, or other configuration. The speaker types may include full range direct speakers, speaker arrays, surround speakers, subwoofers, tweeters, and other types of speakers.

Audio objects can be considered as groups of sound elements that may be perceived to emanate from a particular physical location or locations in the listening environment. Such objects can be static (that is, stationary) or dynamic (that is, moving). Audio objects are controlled by metadata that defines the position of the sound at a given point in time, along with other functions. When objects are played back, they are rendered according to the positional metadata using the speakers that are present, rather than necessarily being output to a predefined physical channel. A track in a session can be an audio object, and standard panning data is analogous to positional metadata. In this way, content placed on the screen might pan in effectively the same way as with channel-based content, but content placed in the surrounds can be rendered to an individual speaker if desired. While the use of audio objects provides the desired control for discrete effects, other aspects of a soundtrack may work effectively in a channel-based environment. For example, many ambient effects or reverberation actually benefit from being fed to arrays of speakers. Although these could be treated as objects with sufficient width to fill an array, it is beneficial to retain some channel-based functionality.

Figure 2:
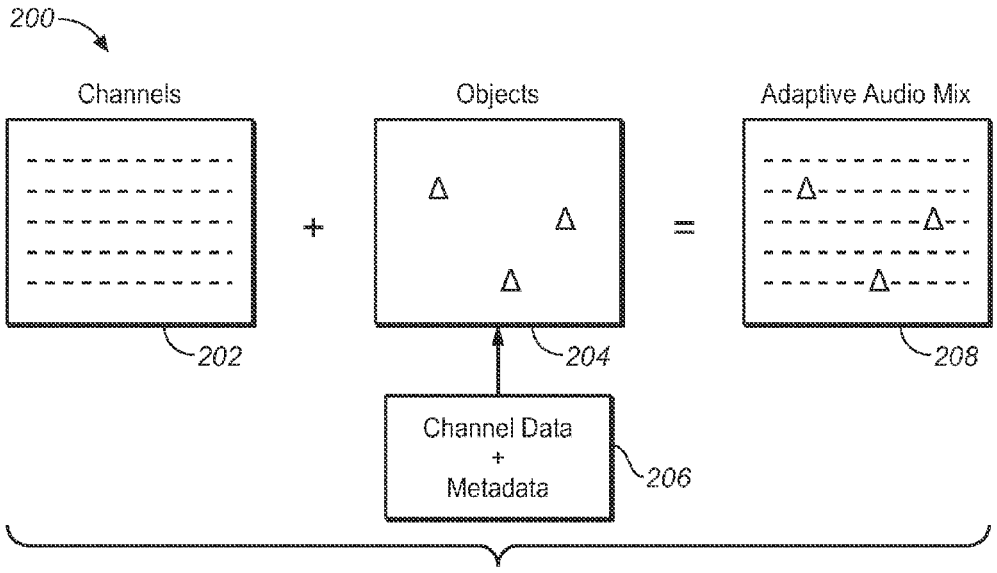
FIG. 2 illustrates the combination of channel and object-based data to produce an adaptive audio mix, under an embodiment.

The adaptive audio system is configured to support "beds" in addition to audio objects, where beds are effectively channel-based sub-mixes or stems. These can be delivered for final playback (rendering) either individually, or combined into a single bed, depending on the intent of the content creator. These beds can be created in different channel-based configurations such as 5.1, 7.1, and 9.1, and arrays that include overhead speakers, such as shown in FIG. 1. FIG. 2 illustrates the combination of channel and object-based data to produce an adaptive audio mix, under an embodiment. As shown in process 200, the channel-based data 202, which, for example, may be 5.1 or 7.1 surround sound data provided in the form of pulse-code modulated (PCM) data is combined with audio object data 204 to produce an adaptive audio mix 208. The audio object data 204 is produced by combining the elements of the original channel-based data with associated metadata that specifies certain parameters pertaining to the location of the audio objects. As shown conceptually in FIG. 2, the authoring tools provide the ability to create audio programs that contain a combination of speaker channel groups and object channels simultaneously. For example, an audio program could contain one or more speaker channels optionally organized into groups (or tracks, e.g. a stereo or 5.1 track), descriptive metadata for one or more speaker channels, one or more object channels, and descriptive metadata for one or more object channels.

An adaptive audio system effectively moves beyond simple "speaker feeds" as a means for distributing spatial audio, and advanced model-based audio descriptions have been developed that allow the listener the freedom to select a playback configuration that suits their individual needs or budget and have the audio rendered specifically for their individually chosen configuration. At a high level, there are four main spatial audio description formats: (1) speaker feed, where the audio is described as signals intended for loudspeakers located at nominal speaker positions; (2) microphone feed, where the audio is described as signals captured by actual or virtual microphones in a predefined configuration (the number of microphones and their relative position); (3) model-based description, where the audio is described in terms of a sequence of audio events at described times and positions; and (4) binaural, where the audio is described by the signals that arrive at the two ears of a listener.

The four description formats are often associated with the following common rendering technologies, where the term "rendering" means conversion to electrical signals used as speaker feeds: (1) panning, where the audio stream is converted to speaker feeds using a set of panning laws and known or assumed speaker positions (typically rendered prior to distribution); (2) Ambisonics, where the microphone signals are converted to feeds for a scalable array of loudspeakers (typically rendered after distribution); (3) Wave Field Synthesis (WFS), where sound events are converted to the appropriate speaker signals to synthesize a sound field (typically rendered after distribution); and (4) binaural, where the L/R binaural signals are delivered to the L/R ear, typically through headphones, but also through speakers in conjunction with crosstalk cancellation.

In general, any format can be converted to another format (though this may require blind source separation or similar technology) and rendered using any of the aforementioned technologies; however, not all transformations yield good results in practice. The speaker-feed format is the most common because it is simple and effective. The best sonic results (that is, the most accurate and reliable) are achieved by mixing/monitoring in and then distributing the speaker feeds directly because there is no processing required between the content creator and listener. If the playback system is known in advance, a speaker feed description provides the highest fidelity; however, the playback system and its configuration are often not known beforehand. In contrast, the model-based description is the most adaptable because it makes no assumptions about the playback system and is therefore most easily applied to multiple rendering technologies. The model-based description can efficiently capture spatial information, but becomes very inefficient as the number of audio sources increases.

The adaptive audio system combines the benefits of both the channel and model-based systems, with specific benefits including high timbre quality, optimal reproduction of artistic intent when mixing and rendering using the same channel configuration, single inventory with "downward" adaption to the rendering configuration, relatively low impact on system pipeline, and increased immersion via finer horizontal speaker spatial resolution and new height channels. The adaptive audio system provides several new features including: a single inventory with downward and upward adaption to a specific cinema rendering configuration, i.e., delay rendering and optimal use of available speakers in a playback environment; increased envelopment, including optimized downmixing to avoid inter-channel correlation (ICC) artifacts; increased spatial resolution via steer-thru arrays (e.g., allowing an audio object to be dynamically assigned to one or more loudspeakers within a surround array); and increased front channel resolution via a high resolution center or similar speaker configuration.

The spatial effects of audio signals are critical in providing an immersive experience for the listener. Sounds that are meant to emanate from a specific region of a viewing screen or listening environment should be played through speaker(s) located at that same relative location. Thus, the primary audio metadatum of a sound event in a model-based description is position, though other parameters such as size, orientation, velocity and acoustic dispersion can also be described. To convey position, a model-based, 3D audio spatial description requires a 3D coordinate system. The coordinate system used for transmission (Euclidean, spherical, cylindrical) is generally chosen for convenience or compactness; however, other coordinate systems may be used for the rendering processing. In addition to a coordinate system, a frame of reference is required for representing the locations of objects in space. For systems to accurately reproduce position-based sound in a variety of different environments, selecting the proper frame of reference can be critical. With an allocentric reference frame, an audio source position is defined relative to features within the rendering environment such as room walls and corners, standard speaker locations, and screen location. In an egocentric reference frame, locations are represented with respect to the perspective of the listener, such as "in front of me," "slightly to the left," and so on. Scientific studies of spatial perception (audio and otherwise) have shown that the egocentric perspective is used almost universally. For cinema, however, the allocentric frame of reference is generally more appropriate. For example, the precise location of an audio object is most important when there is an associated object on screen. When using an allocentric reference, for every listening position and for any screen size, the sound will localize at the same relative position on the screen, e.g., "one-third left of the middle of the screen." Another reason is that mixers tend to think and mix in allocentric terms, and panning tools are laid out with an allocentric frame (that is, the room walls), and mixers expect them to be rendered that way, e.g., "this sound should be on screen," "this sound should be off screen," or "from the left wall," and so on.

Despite the use of the allocentric frame of reference in the cinema environment, there are some cases where an egocentric frame of reference may be useful and more appropriate. These include non-diegetic sounds, i.e., those that are not present in the "story space," e.g., mood music, for which an egocentrically uniform presentation may be desirable. Another case is near-field effects (e.g., a buzzing mosquito in the listener's left ear) that require an egocentric representation. In addition, infinitely far sound sources (and the resulting plane waves) may appear to come from a constant egocentric position (e.g., 30 degrees to the left), and such sounds are easier to describe in egocentric terms than in allocentric terms. In the some cases, it is possible to use an allocentric frame of reference as long as a nominal listening position is defined, while some examples require an egocentric representation that is not yet possible to render. Although an allocentric reference may be more useful and appropriate, the audio representation should be extensible, since many new features, including egocentric representation may be more desirable in certain applications and listening environments.

Figure 3:
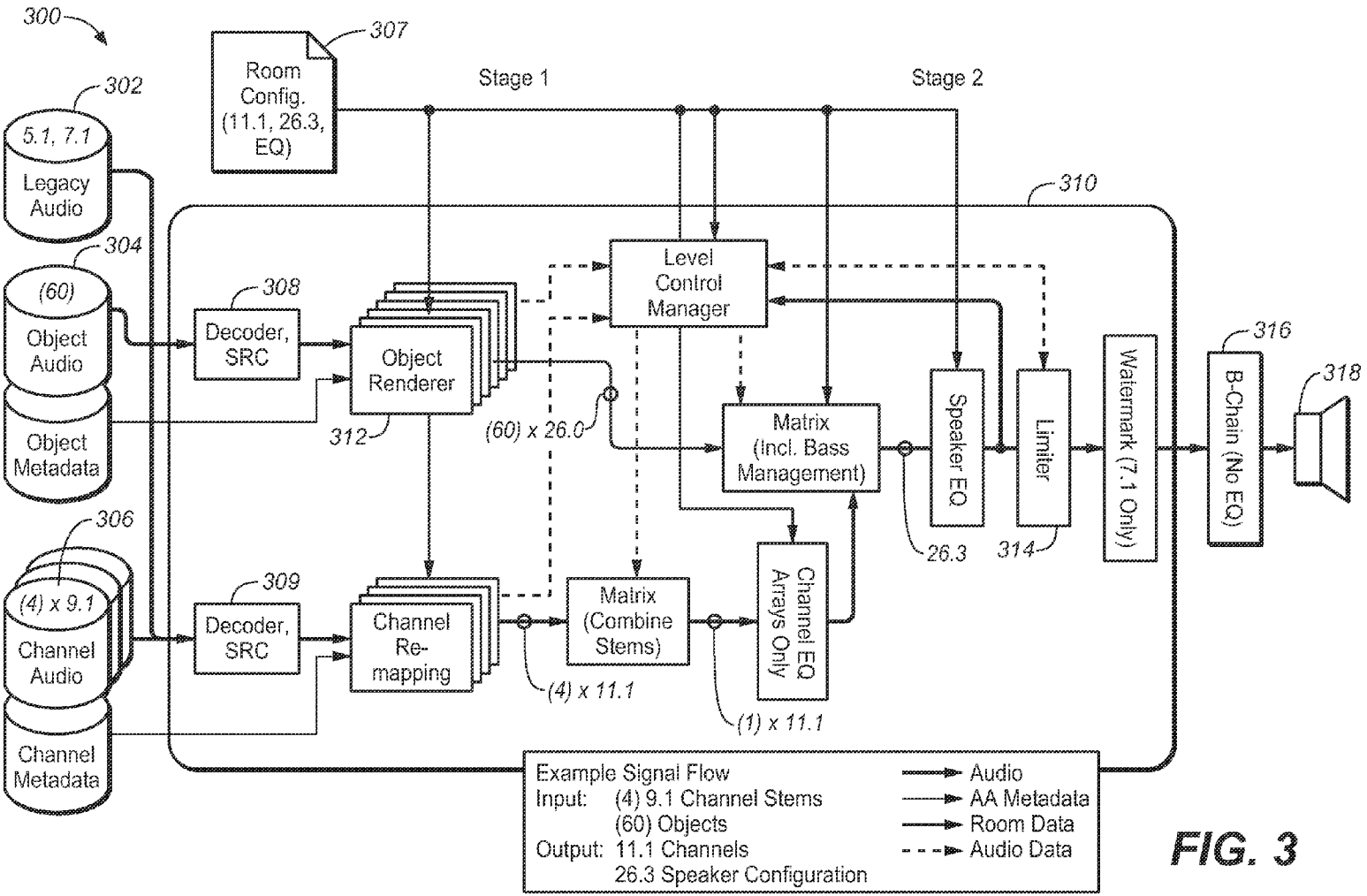
FIG. 3 is a block diagram of a playback architecture for use in an adaptive audio system, under an embodiment.

Embodiments of the adaptive audio system include a hybrid spatial description approach that includes a recommended channel configuration for optimal fidelity and for rendering of diffuse or complex, multi-point sources (e.g., stadium crowd, ambiance) using an egocentric reference, plus an allocentric, model-based sound description to efficiently enable increased spatial resolution and scalability. FIG. 3 is a block diagram of a playback architecture for use in an adaptive audio system, under an embodiment. The system of FIG. 3 includes processing blocks that perform legacy, object and channel audio decoding, objecting rendering, channel remapping and signal processing prior to the audio being sent to post-processing and/or amplification and speaker stages.

The playback system 300 is configured to render and playback audio content that is generated through one or more capture, pre-processing, authoring and coding components. An adaptive audio pre-processor may include source separation and content type detection functionality that automatically generates appropriate metadata through analysis of input audio. For example, positional metadata may be derived from a multi-channel recording through an analysis of the relative levels of correlated input between channel pairs. Detection of content type, such as "speech" or "music", may be achieved, for example, by feature extraction and classification. Certain authoring tools allow the authoring of audio programs by optimizing the input and codification of the sound engineer's creative intent allowing him to create the final audio mix once that is optimized for playback in practically any playback environment. This can be accomplished through the use of audio objects and positional data that is associated and encoded with the original audio content. In order to accurately place sounds around an auditorium, the sound engineer needs control over how the sound will ultimately be rendered based on the actual constraints and features of the playback environment. The adaptive audio system provides this control by allowing the sound engineer to change how the audio content is designed and mixed through the use of audio objects and positional data. Once the adaptive audio content has been authored and coded in the appropriate codec devices, it is decoded and rendered in the various components of playback system 300.

As shown in FIG. 3, (1) legacy surround-sound audio 302, (2) object audio including object metadata 304, and (3) channel audio including channel metadata 306 are input to decoder states 308, 309 within processing block 310. The object metadata is rendered in object renderer 312, while the channel metadata may be remapped as necessary. Listening environment configuration information 307 is provided to the object renderer and channel re-mapping component. The hybrid audio data is then processed through one or more signal processing stages, such as equalizers and limiters 314 prior to output to the B-chain processing stage 316 and playback through speakers 318. System 300 represents an example of a playback system for adaptive audio, and other configurations, components, and interconnections are also possible.

The system of FIG. 3 illustrates an embodiment in which the renderer comprises a component that applies object metadata to the input audio channels for processing object-based audio content in conjunction with optional channel-based audio content. Embodiments may also be directed to a case in which the input audio channels comprise legacy channel-based content only, and the renderer comprises a component that generates speaker feeds for transmission to an array of drivers in a surround-sound configuration. In this case, the input is not necessarily object-based content, but legacy 5.1 or 7.1 (or other non-object based) content, such a provided in Dolby Digital or Dolby Digital Plus, or similar systems.

Playback Applications

As mentioned above, an initial implementation of the adaptive audio format and system is in the digital cinema (D-cinema) context that includes content capture (objects and channels) that are authored using novel authoring tools, packaged using an adaptive audio cinema encoder, and distributed using PCM or a proprietary lossless codec using the existing Digital Cinema Initiative (DCI) distribution mechanism. In this case, the audio content is intended to be decoded and rendered in a digital cinema to create an immersive spatial audio cinema experience. However, as with previous cinema improvements, such as analog surround sound, digital multi-channel audio, etc., there is an imperative to deliver the enhanced user experience provided by the adaptive audio format directly to users in their homes. This requires that certain characteristics of the format and system be adapted for use in more limited listening environments. For example, homes, rooms, small auditorium or similar places may have reduced space, acoustic properties, and equipment capabilities as compared to a cinema or theater environment. For purposes of description, the term "consumer-based environment" is intended to include any non-cinema environment that comprises a listening environment for use by regular consumers or professionals, such as a house, studio, room, console area, auditorium, and the like. The audio content may be sourced and rendered alone or it may be associated with graphics content, e.g., still pictures, light displays, video, and so on.

Figure 4A:
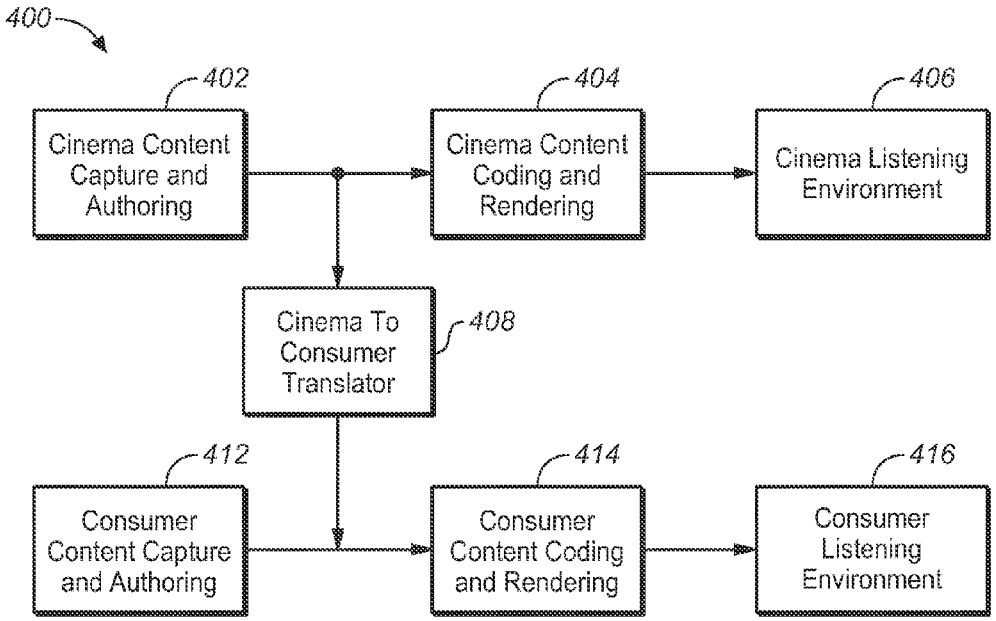
FIG. 4A is a block diagram that illustrates the functional components for adapting cinema based audio content for use in a listening environment under an embodiment.

FIG. 4A is a block diagram that illustrates the functional components for adapting cinema based audio content for use in a listening environment under an embodiment. As shown in FIG. 4A, cinema content typically comprising a motion picture soundtrack is captured and/or authored using appropriate equipment and tools in block 402. In an adaptive audio system, this content is processed through encoding/decoding and rendering components and interfaces in block 404. The resulting object and channel audio feeds are then sent to the appropriate speakers in the cinema or theater, 406. In system 400, the cinema content is also processed for playback in a listening environment, such as a home theater system, 416. It is presumed that the listening environment is not as comprehensive or capable of reproducing all of the sound content as intended by the content creator due to limited space, reduced speaker count, and so on. However, embodiments are directed to systems and methods that allow the original audio content to be rendered in a manner that minimizes the restrictions imposed by the reduced capacity of the listening environment, and allow the positional cues to be processed in a way that maximizes the available equipment. As shown in FIG. 4A, the cinema audio content is processed through cinema to consumer translator component 408 where it is processed in the consumer content coding and rendering chain 414. This chain also processes original audio content that is captured and/or authored in block 412. The original content and/or the translated cinema content are then played back in the listening environment, 416. In this manner, the relevant spatial information that is coded in the audio content can be used to render the sound in a more immersive manner, even using the possibly limited speaker configuration of the home or listening environment 416.

Figure 4C:
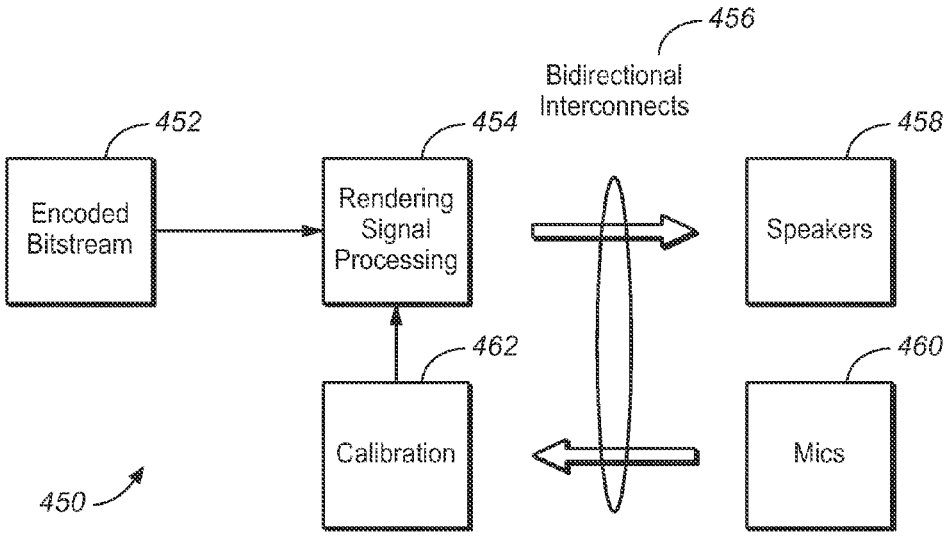
FIG. 4C is a block diagram of the functional components of an adaptive audio environment, under an embodiment.
Figure 4B:
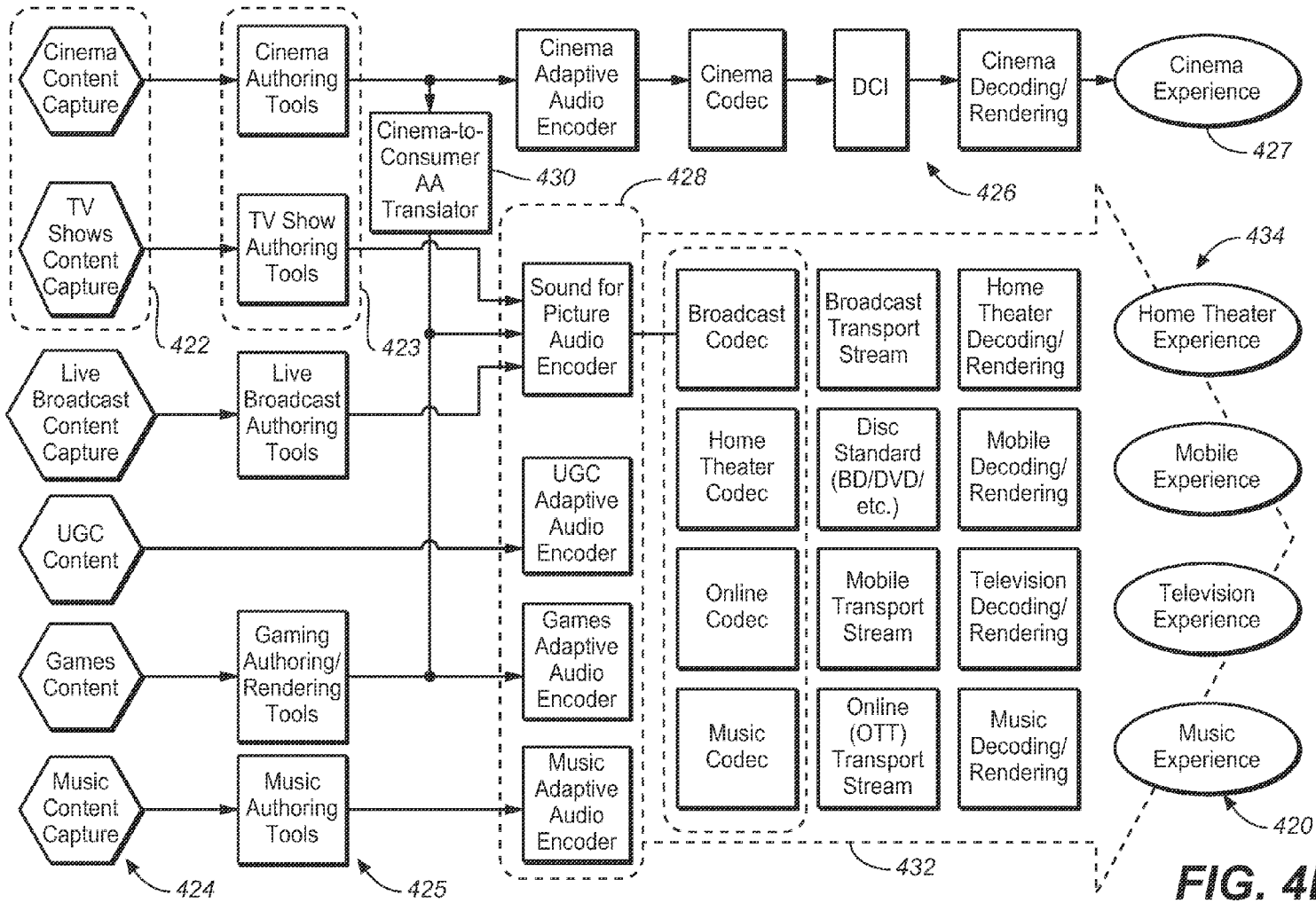
FIG. 4B is a detailed block diagram of the components of FIG. 3A, under an embodiment.

FIG. 4B illustrates the components of FIG. 4A in greater detail. FIG. 4B illustrates an example distribution mechanism for adaptive audio cinema content throughout an audio playback ecosystem. As shown in diagram 420, original cinema and TV content is captured 422 and authored 423 for playback in a variety of different environments to provide a cinema experience 427 or consumer environment experiences 434. Likewise, certain user generated content (UGC) or consumer content is captured 423 and authored 425 for playback in the listening environment 434. Cinema content for playback in the cinema environment 427 is processed through known cinema processes 426. However, in system 420, the output of the cinema authoring tools box 423 also consists of audio objects, audio channels and metadata that convey the artistic intent of the sound mixer. This can be thought of as a mezzanine style audio package that can be used to create multiple versions of the cinema content for playback. In an embodiment, this functionality is provided by a cinema-to-consumer adaptive audio translator 430. This translator has an input to the adaptive audio content and distills from it the appropriate audio and metadata content for the desired consumer end-points 434. The translator creates separate, and possibly different, audio and metadata outputs depending on the distribution mechanism and end-point.

As shown in the example of system 420, the cinema-to-consumer translator 430 feeds sound for picture (broadcast, disc, OTT, etc.) and game audio bitstream creation modules 428. These two modules, which are appropriate for delivering cinema content, can be fed into multiple distribution pipelines 432, all of which may deliver to the consumer end points. For example, adaptive audio cinema content may be encoded using a codec suitable for broadcast purposes such as Dolby Digital Plus, which may be modified to convey channels, objects and associated metadata, and is transmitted through the broadcast chain via cable or satellite and then decoded and rendered in a home for home theater or television playback. Similarly, the same content could be encoded using a codec suitable for online distribution where bandwidth is limited, where it is then transmitted through a 3G or 4G mobile network and then decoded and rendered for playback via a mobile device using headphones. Other content sources such as TV, live broadcast, games and music may also use the adaptive audio format to create and provide content for a next generation audio format.

The system of FIG. 4B provides for an enhanced user experience throughout the entire consumer audio ecosystem which may include home theater (A/V receiver, soundbar, and BluRay), E-media (PC, Tablet, Mobile including headphone playback), broadcast (TV and set-top box), music, gaming, live sound, user generated content ("UGC"), and so on. Such a system provides: enhanced immersion for the audience for all end-point devices, expanded artistic control for audio content creators, improved content dependent (descriptive) metadata for improved rendering, expanded flexibility and scalability for playback systems, timbre preservation and matching, and the opportunity for dynamic rendering of content based on user position and interaction. The system includes several components including new mixing tools for content creators, updated and new packaging and coding tools for distribution and playback, in-home dynamic mixing and rendering (appropriate for different configurations), additional speaker locations and designs The adaptive audio ecosystem is configured to be a fully comprehensive, end-to-end, next generation audio system using the adaptive audio format that includes content creation, packaging, distribution and playback/rendering across a wide number of end-point devices and use cases. As shown in FIG. 4B, the system originates with content captured from and for a number different use cases, 422 and 424. These capture points include all relevant content formats including cinema, TV, live broadcast (and sound), UGC, games and music. The content as it passes through the ecosystem, goes through several key phases, such as pre-processing and authoring tools, translation tools (i.e., translation of adaptive audio content for cinema to consumer content distribution applications), specific adaptive audio packaging/bitstream encoding (which captures audio essence data as well as additional metadata and audio reproduction information), distribution encoding using existing or new codecs (e.g., DD+, TrueHD, Dolby Pulse) for efficient distribution through various audio channels, transmission through the relevant distribution channels (broadcast, disc, mobile, Internet, etc.) and finally end-point aware dynamic rendering to reproduce and convey the adaptive audio user experience defined by the content creator that provides the benefits of the spatial audio experience. The adaptive audio system can be used during rendering for a widely varying number of consumer end-points, and the rendering technique that is applied can be optimized depending on the end-point device. For example, home theater systems and soundbars may have 2, 3, 5, 7 or even 9 separate speakers in various locations. Many other types of systems have only two speakers (TV, laptop, music dock) and nearly all commonly used devices have a headphone output (PC, laptop, tablet, cell phone, music player, and so on).

Current authoring and distribution systems for surround-sound audio create and deliver audio that is intended for reproduction to pre-defined and fixed speaker locations with limited knowledge of the type of content conveyed in the audio essence (i.e. the actual audio that is played back by the reproduction system). The adaptive audio system, however, provides a new hybrid approach to audio creation that includes the option for both fixed speaker location specific audio (left channel, right channel, etc.) and object-based audio elements that have generalized 3D spatial information including position, size and velocity. This hybrid approach provides a balanced approach for fidelity (provided by fixed speaker locations) and flexibility in rendering (generalized audio objects). This system also provides additional useful information about the audio content via new metadata that is paired with the audio essence by the content creator at the time of content creation/authoring. This information provides detailed information about the attributes of the audio that can be used during rendering. Such attributes may include content type (dialog, music, effect, Foley, background/ambience, etc.) as well as audio object information such as spatial attributes (3D position, object size, velocity, etc.) and useful rendering information (snap to speaker location, channel weights, gain, bass management information, etc.). The audio content and reproduction intent metadata can either be manually created by the content creator or created through the use of automatic, media intelligence algorithms that can be run in the background during the authoring process and be reviewed by the content creator during a final quality control phase if desired.

FIG. 4C is a block diagram of the functional components of an adaptive audio environment under an embodiment. As shown in diagram 450, the system processes an encoded bitstream 452 that carries both a hybrid object and channel-based audio stream. The bitstream is processed by rendering/signal processing block 454. In an embodiment, at least portions of this functional block may be implemented in the rendering block 312 illustrated in FIG. 3. The rendering function 454 implements various rendering algorithms for adaptive audio, as well as certain post-processing algorithms, such as upmixing, processing direct versus reflected sound, and the like. Output from the renderer is provided to the speakers 458 through bidirectional interconnects 456. In an embodiment, the speakers 458 comprise a number of individual drivers that may be arranged in a surround-sound, or similar configuration. The drivers are individually addressable and may be embodied in individual enclosures or multi-driver cabinets or arrays. The system 450 may also include microphones 460 that provide measurements of listening environment or room characteristics that can be used to calibrate the rendering process. System configuration and calibration functions are provided in block 462. These functions may be included as part of the rendering components, or they may be implemented as a separate components that are functionally coupled to the renderer. The bi-directional interconnects 456 provide the feedback signal path from the speakers in the listening environment back to the calibration component 462.

Listening Environments

Figure 5:
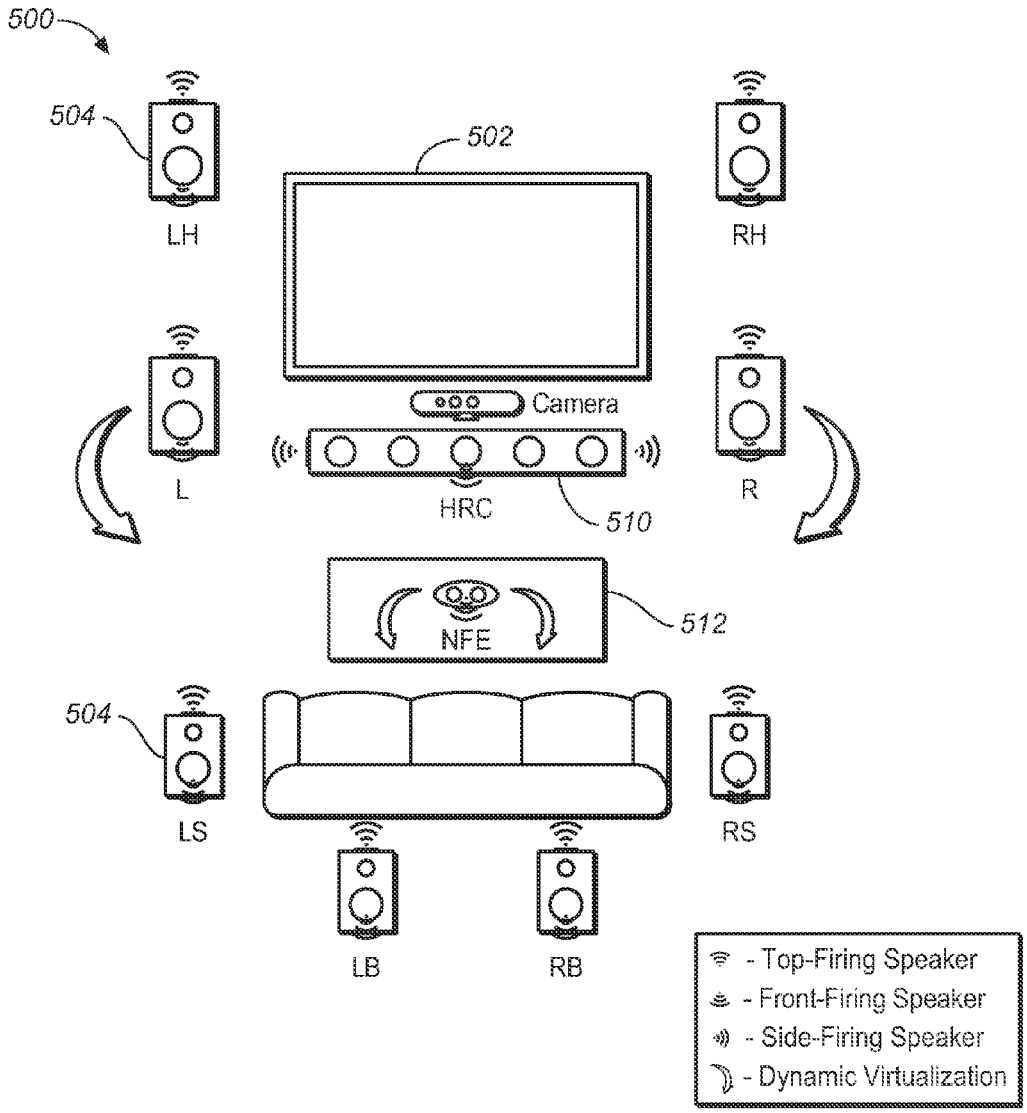
FIG. 5 illustrates the deployment of an adaptive audio system in an example home theater environment.

Implementations of the adaptive audio system can be deployed in a variety of different listening environments. These include three primary areas of audio playback applications: home theater systems, televisions and soundbars, and headphones. FIG. 5 illustrates the deployment of an adaptive audio system in an example home theater environment. The system of FIG. 5 illustrates a superset of components and functions that may be provided by an adaptive audio system, and certain aspects may be reduced or removed based on the user's needs, while still providing an enhanced experience. The system 500 includes various different speakers and drivers in a variety of different cabinets or arrays 504. The speakers include individual drivers that provide front, side and upward-firing options, as well as dynamic virtualization of audio using certain audio processing techniques. Diagram 500 illustrates a number of speakers deployed in a standard 9.1 speaker configuration. These include left and right height speakers (LH, RH), left and right speakers (L, R), a center speaker (shown as a modified center speaker), and left and right surround and back speakers (LS, RS, LB, and RB, the low frequency element LFE is not shown).

FIG. 5 illustrates the use of a center channel speaker 510 used in a central location of the listening environment. In an embodiment, this speaker is implemented using a modified center channel or high-resolution center channel 510. Such a speaker may be a front firing center channel array with individually addressable speakers that allow discrete pans of audio objects through the array that match the movement of video objects on the screen. It may be embodied as a high-resolution center channel (HRC) speaker, such as that described in International Application Number PCT/US2011/028783, which is hereby incorporated by reference in its entirety. The HRC speaker 510 may also include side-firing speakers, as shown. These could be activated and used if the HRC speaker is used not only as a center speaker but also as a speaker with soundbar capabilities. The HRC speaker may also be incorporated above and/or to the sides of the screen 502 to provide a two-dimensional, high resolution panning option for audio objects. The center speaker 510 could also include additional drivers and implement a steerable sound beam with separately controlled sound zones.

System 500 also includes a near field effect (NFE) speaker 512 that may be located right in front, or close in front of the listener, such as on table in front of a seating location. With adaptive audio it is possible to bring audio objects into the room and not just locked to the perimeter of the room. Therefore, having objects traverse through the three-dimensional space is an option. An example is where an object may originate in the L speaker, travel through the listening environment through the NFE speaker, and terminate in the RS speaker. Various different speakers may be suitable for use as an NFE speaker, such as a wireless, battery-powered speaker.

FIG. 5 illustrates the use of dynamic speaker virtualization to provide an immersive user experience in the home theater environment. Dynamic speaker virtualization is enabled through dynamic control of the speaker virtualization algorithms parameters based on object spatial information provided by the adaptive audio content. This dynamic virtualization is shown in FIG. 5 for the L and R speakers where it is natural to consider it for creating the perception of objects moving along the sides of the listening environment. A separate virtualizer may be used for each relevant object and the combined signal can be sent to the L and R speakers to create a multiple object virtualization effect. The dynamic virtualization effects are shown for the L and R speakers, as well as the NFE speaker, which is intended to be a stereo speaker (with two independent inputs). This speaker, along with audio object size and position information, could be used to create either a diffuse or point source near field audio experience. Similar virtualization effects can also be applied to any or all of the other speakers in the system. In an embodiment, a camera may provide additional listener position and identity information that could be used by the adaptive audio renderer to provide a more compelling experience more true to the artistic intent of the mixer.

The adaptive audio renderer understands the spatial relationship between the mix and the playback system. In some instances of a playback environment, discrete speakers may be available in all relevant areas of the listening environment, including overhead positions, as shown in FIG. 1. In these cases where discrete speakers are available at certain locations, the renderer can be configured to "snap" objects to the closest speakers instead of creating a phantom image between two or more speakers through panning or the use of speaker virtualization algorithms. While it slightly distorts the spatial representation of the mix, it also allows the renderer to avoid unintended phantom images. For example, if the angular position of the mixing stage's left speaker does not correspond to the angular position of the playback system's left speaker, enabling this function would avoid having a constant phantom image of the initial left channel.

In many cases however, and especially in a home environment, certain speakers, such as ceiling mounted overhead speakers are not available. In this case, certain virtualization techniques are implemented by the renderer to reproduce overhead audio content through existing floor or wall mounted speakers. In an embodiment, the adaptive audio system includes a modification to the standard configuration through the inclusion of both a front-firing capability and a top (or "upward") firing capability for each speaker. In traditional home applications, speaker manufacturers have attempted to introduce new driver configurations other than front-firing transducers and have been confronted with the problem of trying to identify which of the original audio signals (or modifications to them) should be sent to these new drivers. With the adaptive audio system there is very specific information regarding which audio objects should be rendered above the standard horizontal plane. In an embodiment, height information present in the adaptive audio system is rendered using the upward-firing drivers. Likewise, side-firing speakers can be used to render certain other content, such as ambience effects.

One advantage of the upward-firing drivers is that they can be used to reflect sound off of a hard ceiling surface to simulate the presence of overhead/height speakers positioned in the ceiling. A compelling attribute of the adaptive audio content is that the spatially diverse audio is reproduced using an array of overhead speakers. As stated above, however, in many cases, installing overhead speakers is too expensive or impractical in a home environment. By simulating height speakers using normally positioned speakers in the horizontal plane, a compelling 3D experience can be created with easy to position speakers. In this case, the adaptive audio system is using the upward-firing/height simulating drivers in a new way in that audio objects and their spatial reproduction information are being used to create the audio being reproduced by the upward-firing drivers.

Figure 6:
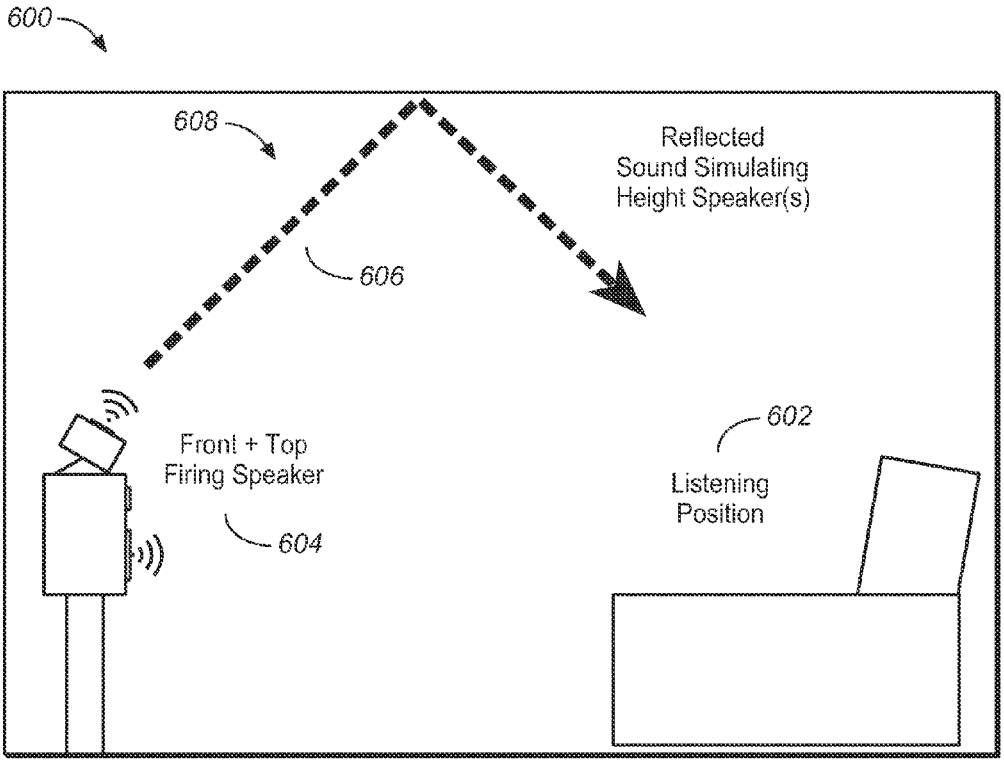
FIG. 6 illustrates the use of an upward-firing driver using reflected sound to simulate an overhead speaker in a listening environment.

FIG. 6 illustrates the use of an upward-firing driver using reflected sound to simulate a single overhead speaker in a home theater. It should be noted that any number of upward-firing drivers could be used in combination to create multiple simulated height speakers. Alternatively, a number of upward-firing drivers may be configured to transmit sound to substantially the same spot on the ceiling to achieve a certain sound intensity or effect. Diagram 600 illustrates an example in which the usual listening position 602 is located at a particular place within a listening environment. The system does not include any height speakers for transmitting audio content containing height cues. Instead, the speaker cabinet or speaker array 604 includes an upward-firing driver along with the front firing driver(s). The upward-firing driver is configured (with respect to location and inclination angle) to send its sound wave 606 up to a particular point on the ceiling 608 where it will be reflected back down to the listening position 602. It is assumed that the ceiling is made of an appropriate material and composition to adequately reflect sound down into the listening environment. The relevant characteristics of the upward-firing driver (e.g., size, power, location, etc.) may be selected based on the ceiling composition, room size, and other relevant characteristics of the listening environment. Although only one upward-firing driver is shown in FIG. 6, multiple upward-firing drivers may be incorporated into a reproduction system in some embodiments.

In an embodiment, the adaptive audio system utilizes upward-firing drivers to provide the height element. In general, it has been shown that incorporating signal processing to introduce perceptual height cues into the audio signal being fed to the upward-firing drivers improves the positioning and perceived quality of the virtual height signal. For example, a parametric perceptual binaural hearing model has been developed to create a height cue filter, which when used to process audio being reproduced by an upward-firing driver, improves that perceived quality of the reproduction. In an embodiment, the height cue filter is derived from the both the physical speaker location (approximately level with the listener) and the reflected speaker location (above the listener). For the physical speaker location, a directional filter is determined based on a model of the outer ear (or pinna). An inverse of this filter is next determined and used to remove the height cues from the physical speaker. Next, for the reflected speaker location, a second directional filter is determined, using the same model of the outer ear. This filter is applied directly, essentially reproducing the cues the ear would receive if the sound were above the listener. In practice, these filters may be combined in a way that allows for a single filter that both (1) removes the height cue from the physical speaker location, and (2) inserts the height cue from the reflected speaker location. FIG. 16 is a graph that illustrates the frequency response for such a combined filter. The combined filter may be used in a fashion that allows for some adjustability with respect to the aggressiveness or amount of filtering that is applied. For example, in some cases, it may be beneficial to not fully remove the physical speaker height cue, or fully apply the reflected speaker height cue since only some of the sound from the physical speaker arrives directly to the listener (with the remainder being reflected off the ceiling).

Speaker Configuration

A main consideration of the adaptive audio system is the speaker configuration. The system utilizes individually addressable drivers, and an array of such drivers is configured to provide a combination of both direct and reflected sound sources. A bi-directional link to the system controller (e.g., A/V receiver, set-top box) allows audio and configuration data to be sent to the speaker, and speaker and sensor information to be sent back to the controller, creating an active, closed-loop system.

Figure 7A:
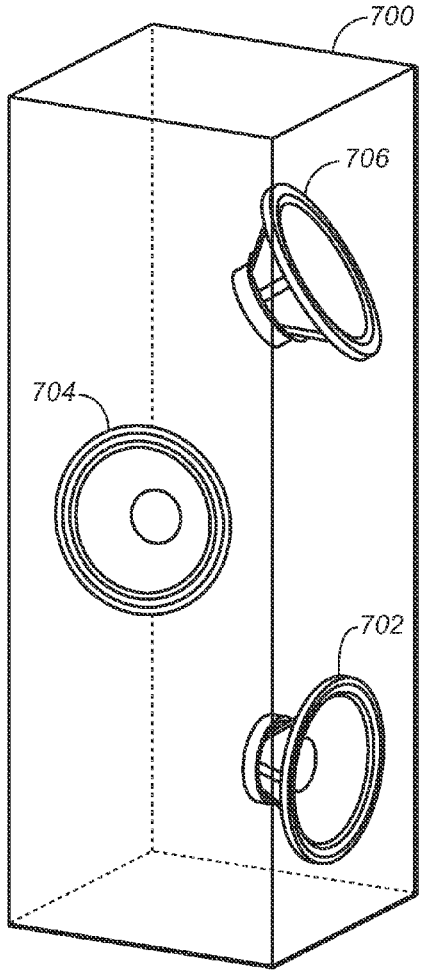
FIG. 7A illustrates a speaker having a plurality of drivers in a first configuration for use in an adaptive audio system having a reflected sound renderer, under an embodiment.

For purposes of description, the term "driver" means a single electroacoustic transducer that produces sound in response to an electrical audio input signal. A driver may be implemented in any appropriate type, geometry and size, and may include horns, cones, ribbon transducers, and the like. The term "speaker" means one or more drivers in a unitary enclosure. FIG. 7A illustrates a speaker having a plurality of drivers in a first configuration, under an embodiment. As shown in FIG. 7A, a speaker enclosure 700 has a number of individual drivers mounted within the enclosure. Typically the enclosure will include one or more front-firing drivers 702, such as woofers, midrange speakers, or tweeters, or any combination thereof. One or more side-firing drivers 704 may also be included. The front and side-firing drivers are typically mounted flush against the side of the enclosure such that they project sound perpendicularly outward from the vertical plane defined by the speaker, and these drivers are usually permanently fixed within the cabinet 700. For the adaptive audio system that features the rendering of reflected sound, one or more upward tilted drivers 706 are also provided. These drivers are positioned such that they project sound at an angle up to the ceiling where it can then bounce back down to a listener, as shown in FIG. 6. The degree of tilt may be set depending on listening environment characteristics and system requirements. For example, the upward driver 706 may be tilted up between 30 and 60 degrees and may be positioned above the front-firing driver 702 in the speaker enclosure 700 so as to minimize interference with the sound waves produced from the front-firing driver 702. The upward-firing driver 706 may be installed at fixed angle, or it may be installed such that the tilt angle of may be adjusted manually. Alternatively, a servo-mechanism may be used to allow automatic or electrical control of the tilt angle and projection direction of the upward-firing driver. For certain sounds, such as ambient sound, the upward-firing driver may be pointed straight up out of an upper surface of the speaker enclosure 700 to create what might be referred to as a "top-firing" driver. In this case, a large component of the sound may reflect back down onto the speaker, depending on the acoustic characteristics of the ceiling. In most cases, however, some tilt angle is usually used to help project the sound through reflection off the ceiling to a different or more central location within the listening environment, as shown in FIG. 6.

Figure 7B:
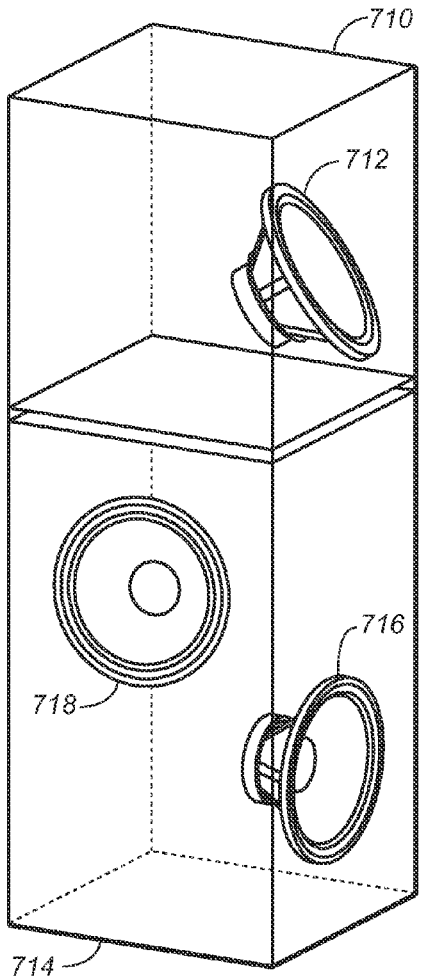
FIG. 7B illustrates a speaker system having drivers distributed in multiple enclosures for use in an adaptive audio system having a reflected sound renderer, under an embodiment.
Figure 7C:
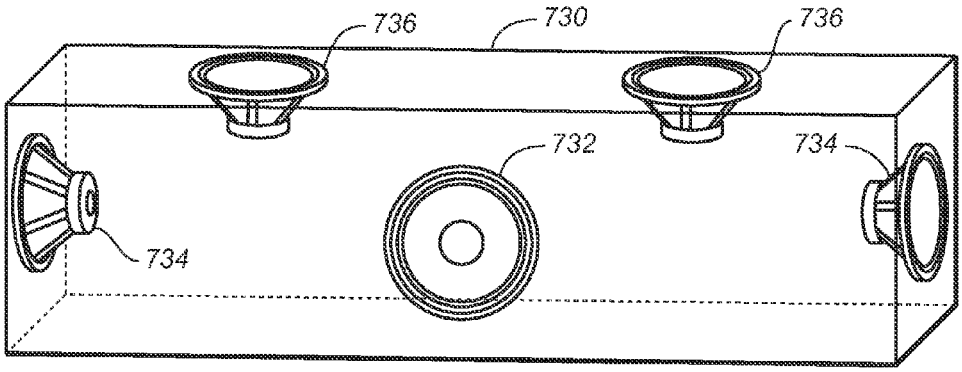
FIG. 7C illustrates an example configuration for a soundbar used in an adaptive audio system using a reflected sound renderer, under an embodiment.

FIG. 7A is intended to illustrate one example of a speaker and driver configuration, and many other configurations are possible. For example, the upward-firing driver may be provided in its own enclosure to allow use with existing speakers. FIG. 7B illustrates a speaker system having drivers distributed in multiple enclosures, under an embodiment. As shown in FIG. 7B, the upward-firing driver 712 is provided in a separate enclosure 710, which can then be placed proximate to or on top of an enclosure 714 having front and/or side-firing drivers 716 and 718. The drivers may also be enclosed within a speaker soundbar, such as used in many home theater environments, in which a number of small or medium sized drivers are arrayed along an axis within a single horizontal or vertical enclosure. FIG. 7C illustrates the placement of drivers within a soundbar, under an embodiment. In this example, soundbar enclosure 730 is a horizontal soundbar that includes side-firing drivers 734, upward-firing drivers 736, and front-firing driver(s) 732. FIG. 7C is intended to be an example configuration only, and any practical number of drivers for each of the functions—front, side, and upward-firing—may be used.

For the embodiment of FIGS. 7A-C, it should be noted that the drivers may be of any appropriate, shape, size and type depending on the frequency response characteristics required, as well as any other relevant constraints, such as size, power rating, component cost, and so on.

Figure 8:
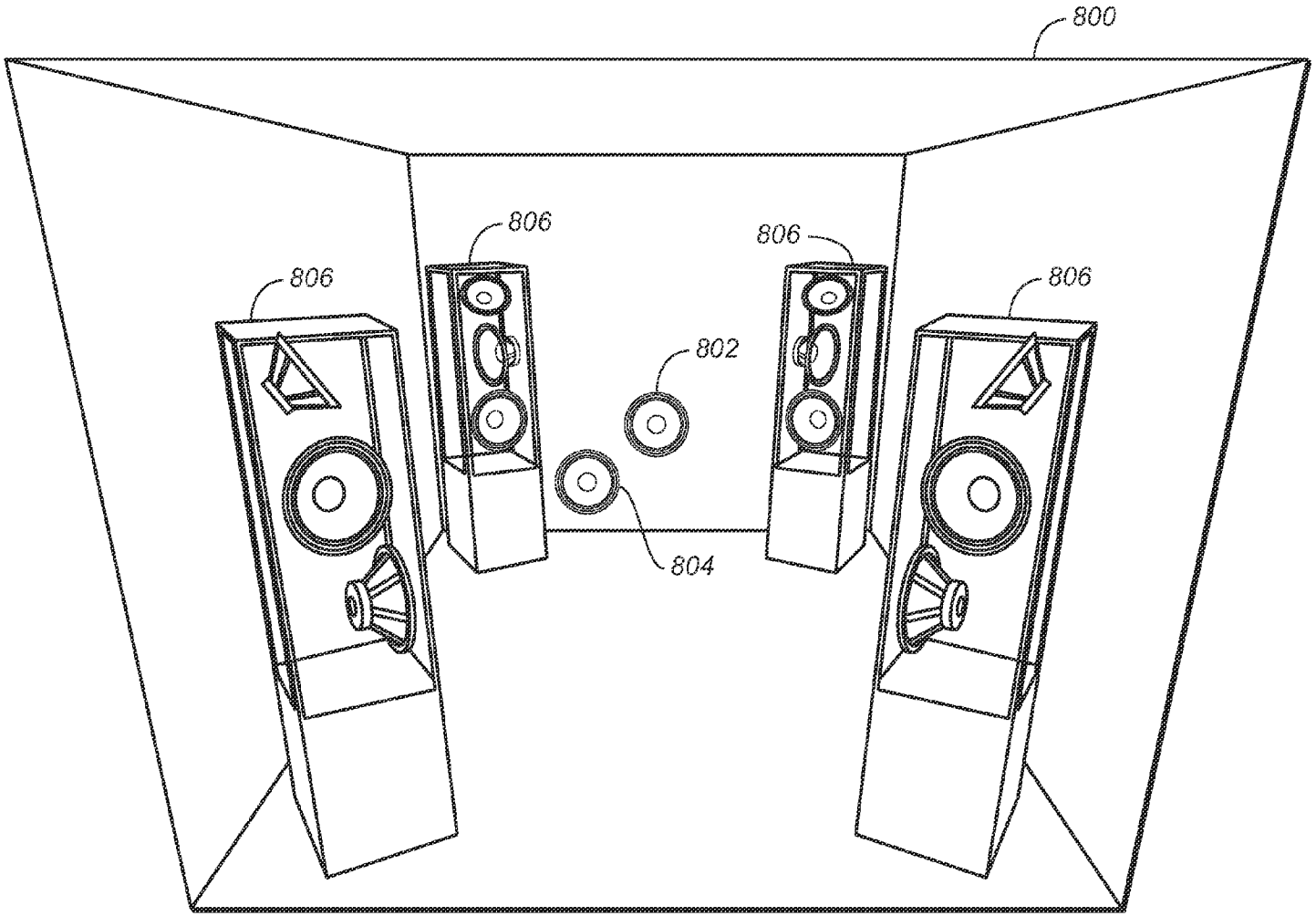
FIG. 8 illustrates an example placement of speakers having individually addressable drivers including upward-firing drivers placed within a listening environment.

In a typical adaptive audio environment, a number of speaker enclosures will be contained within the listening environment. FIG. 8 illustrates an example placement of speakers having individually addressable drivers including upward-firing drivers placed within a listening environment. As shown in FIG. 8, listening environment 800 includes four individual speakers 806, each having at least one front-firing, side-firing, and upward-firing driver. The listening environment may also contain fixed drivers used for surround-sound applications, such as center speaker 802 and subwoofer or LFE 804. As can be seen in FIG. 8, depending on the size of the listening environment and the respective speaker units, the proper placement of speakers 806 within the listening environment can provide a rich audio environment resulting from the reflection of sounds off the ceiling from the number of upward-firing drivers. The speakers can be aimed to provide reflection off of one or more points on the ceiling plane depending on content, listening environment size, listener position, acoustic characteristics, and other relevant parameters.

The speakers used in an adaptive audio system for a home theater or similar listening environment may use a configuration that is based on existing surround-sound configurations (e.g., 5.1, 7.1, 9.1, etc.). In this case, a number of drivers are provided and defined as per the known surround sound convention, with additional drivers and definitions provided for the upward-firing sound components.

Figure 9A:
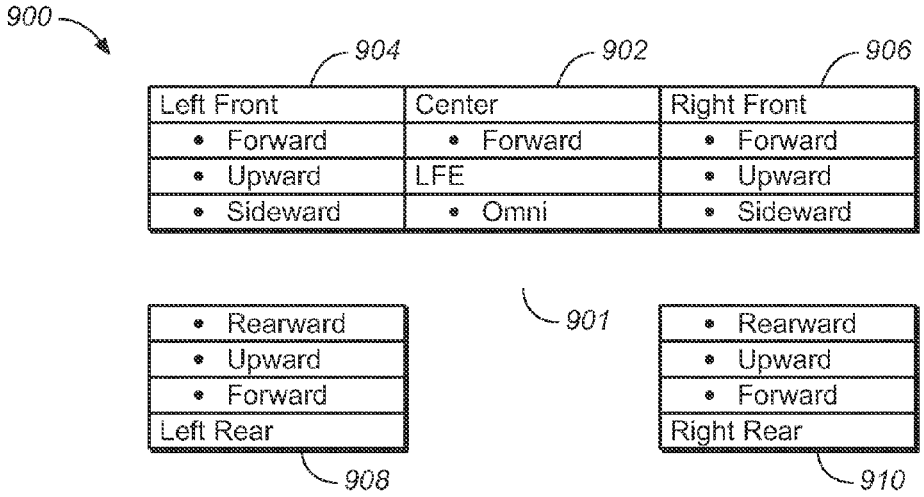
FIG. 9A illustrates a speaker configuration for an adaptive audio 5.1 system utilizing multiple addressable drivers for reflected audio, under an embodiment.

FIG. 9A illustrates a speaker configuration for an adaptive audio 5.1 system utilizing multiple addressable drivers for reflected audio, under an embodiment. In configuration 900, a standard 5.1 loudspeaker footprint comprising LFE 901, center speaker 902, L/R front speakers 904/906, and L/R rear speakers 908/910 is provided with eight additional drivers, giving a total 14 addressable drivers. These eight additional drivers are denoted "upward" and "sideward" in addition to the "forward" (or "front") drivers in each speaker unit 902-910. The direct forward drivers would be driven by sub-channels that contain adaptive audio objects and any other components that are designed to have a high degree of directionality. The upward-firing (reflected) drivers could contain sub-channel content that is more omni-directional or directionless, but is not so limited. Examples would include background music, or environmental sounds. If the input to the system comprises legacy surround-sound content, then this content could be intelligently factored into direct and reflected sub-channels and fed to the appropriate drivers.

For the direct sub-channels, the speaker enclosure would contain drivers in which the median axis of the driver bisects the "sweet-spot", or acoustic center of the listening environment. The upward-firing drivers would be positioned such that the angle between the median plane of the driver and the acoustic center would be some angle in the range of 45 to 180 degrees. In the case of positioning the driver at 180 degrees, the back-facing driver could provide sound diffusion by reflecting off of a back wall. This configuration utilizes the acoustic principal that after time-alignment of the upward-firing drivers with the direct drivers, the early arrival signal component would be coherent, while the late arriving components would benefit from the natural diffusion provided by the listening environment.

In order to achieve the height cues provided by the adaptive audio system, the upward-firing drivers could be angled upward from the horizontal plane, and in the extreme could be positioned to radiate straight up and reflect off of one or more reflective surfaces such as a flat ceiling, or an acoustic diffuser placed immediately above the enclosure. To provide additional directionality, the center speaker could utilize a soundbar configuration (such as shown in FIG. 7C) with the ability to steer sound across the screen to provide a high-resolution center channel.

Figure 9B:
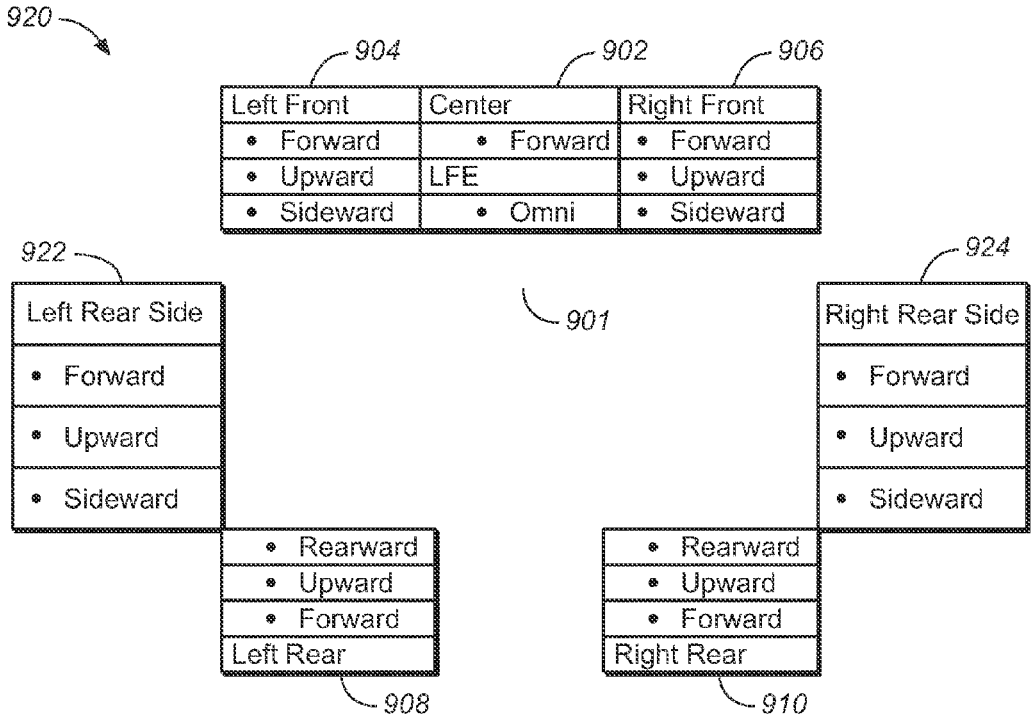
FIG. 9B illustrates a speaker configuration for an adaptive audio 7.1 system utilizing multiple addressable drivers for reflected audio, under an embodiment.

The 5.1 configuration of FIG. 9A could be expanded by adding two additional rear enclosures similar to a standard 7.1 configuration. FIG. 9B illustrates a speaker configuration for an adaptive audio 7.1 system utilizing multiple addressable drivers for reflected audio, under such an embodiment. As shown in configuration 920, the two additional enclosures 922 and 924 are placed in the 'left side surround' and 'right side surround' positions with the side speakers pointing towards the side walls in similar fashion to the front enclosures and the upward-firing drivers set to bounce off the ceiling midway between the existing front and rear pairs. Such incremental additions can be made as many times as desired, with the additional pairs filling the gaps along the side or rear walls. FIGS. 9A and 9B illustrate only some examples of possible configurations of extended surround sound speaker layouts that can be used in conjunction with upward and side-firing speakers in an adaptive audio system for listening environments, and many others are also possible.

As an alternative to the n.1 configurations described above a more flexible pod-based system may be utilized whereby each driver is contained within its own enclosure, which could then be mounted in any convenient location. This would use a driver configuration such as shown in FIG. 7B. These individual units may then be clustered in a similar manner to the n.1 configurations, or they could be spread individually around the listening environment. The pods are not necessary restricted to being placed at the edges of the listening environment, they could also be placed on any surface within it (e.g., coffee table, book shelf, etc.). Such a system would be easy to expand, allowing the user to add more speakers over time to create a more immersive experience. If the speakers are wireless then the pod system could include the ability to dock speakers for recharging purposes. In this design, the pods could be docked together such that they act as a single speaker while they recharge, perhaps for listening to stereo music, and then undocked and positioned around the listening environment for adaptive audio content.

In order to enhance the configurability and accuracy of the adaptive audio system using upward-firing addressable drivers, a number of sensors and feedback devices could be added to the enclosures to inform the renderer of characteristics that could be used in the rendering algorithm. For example, a microphone installed in each enclosure would allow the system to measure the phase, frequency and reverberation characteristics of the listening environment, together with the position of the speakers relative to each other using triangulation and the HRTF-like functions of the enclosures themselves. Inertial sensors (e.g., gyroscopes, compasses, etc.) could be used to detect direction and angle of the enclosures; and optical and visual sensors (e.g., using a laser-based infra-red rangefinder) could be used to provide positional information relative to the listening environment itself. These represent just a few possibilities of additional sensors that could be used in the system, and others are possible as well.

Such sensor systems can be further enhanced by allowing the position of the drivers and/or the acoustic modifiers of the enclosures to be automatically adjustable via electromechanical servos. This would allow the directionality of the drivers to be changed at runtime to suit their positioning in the listening environment relative to the walls and other drivers ("active steering"). Similarly, any acoustic modifiers (such as baffles, horns or wave guides) could be tuned to provide the correct frequency and phase responses for optimal playback in any listening environment configuration ("active tuning"). Both active steering and active tuning could be performed during initial listening environment configuration (e.g., in conjunction with the auto-EQ/auto-room configuration system) or during playback in response to the content being rendered.

Bi-Directional Interconnection

Once configured, the speakers must be connected to the rendering system. Traditional interconnects are typically of two types: speaker-level input for passive speakers and line-level input for active speakers. As shown in FIG. 4C, the adaptive audio system 450 includes a bi-directional interconnection function. This interconnection is embodied within a set of physical and logical connections between the rendering stage 454 and the amplifier/speaker 458 and microphone stages 460. The ability to address multiple drivers in each speaker cabinet is supported by these intelligent interconnects between the sound source and the speaker. The bi-directional interconnect allows for the transmission of signals from the sound source (renderer) to the speaker comprise both control signals and audio signals. The signal from the speaker to the sound source consists of both control signals and audio signals, where the audio signals in this case is audio sourced from the optional built-in microphones. Power may also be provided as part of the bi-directional interconnect, at least for the case where the speakers/drivers are not separately powered.

Figure 10:
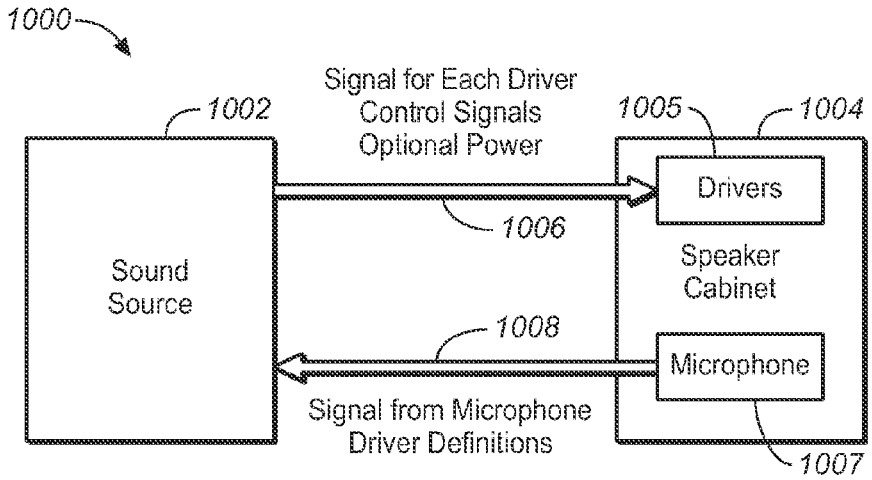
FIG. 10 is a diagram that illustrates the composition of a bi-directional interconnection, under an embodiment.

FIG. 10 is a diagram 1000 that illustrates the composition of a bi-directional interconnection, under an embodiment. The sound source 1002, which may represent a renderer plus amplifier/sound processor chain, is logically and physically coupled to the speaker cabinet 1004 through a pair of interconnect links 1006 and 1008. The interconnect 1006 from the sound source 1002 to drivers 1005 within the speaker cabinet 1004 comprises an electroacoustic signal for each driver, one or more control signals, and optional power. The interconnect 1008 from the speaker cabinet 1004 back to the sound source 1002 comprises sound signals from the microphone 1007 or other sensors for calibration of the renderer, or other similar sound processing functionality. The feedback interconnect 1008 also contains certain driver definitions and parameters that are used by the renderer to modify or process the sound signals set to the drivers over interconnect 1006.

In an embodiment, each driver in each of the cabinets of the system is assigned an identifier (e.g., a numerical assignment) during system setup. Each speaker cabinet (enclosure) can also be uniquely identified. This numerical assignment is used by the speaker cabinet to determine which audio signal is sent to which driver within the cabinet. The assignment is stored in the speaker cabinet in an appropriate memory device. Alternatively, each driver may be configured to store its own identifier in local memory. In a further alternative, such as one in which the drivers/speakers have no local storage capacity, the identifiers can be stored in the rendering stage or other component within the sound source 1002. During a speaker discovery process, each speaker (or a central database) is queried by the sound source for its profile. The profile defines certain driver definitions including the number of drivers in a speaker cabinet or other defined array, the acoustic characteristics of each driver (e.g. driver type, frequency response, and so on), the x, y, z position of center of each driver relative to center of the front face of the speaker cabinet, the angle of each driver with respect to a defined plane (e.g., ceiling, floor, cabinet vertical axis, etc.), and the number of microphones and microphone characteristics. Other relevant driver and microphone/sensor parameters may also be defined. In an embodiment, the driver definitions and speaker cabinet profile may be expressed as one or more XML documents used by the renderer.

In one possible implementation, an Internet Protocol (IP) control network is created between the sound source 1002 and the speaker cabinet 1004. Each speaker cabinet and sound source acts as a single network endpoint and is given a link-local address upon initialization or power-on. An auto-discovery mechanism such as zero configuration networking (zeroconf) may be used to allow the sound source to locate each speaker on the network. Zero configuration networking is an example of a process that automatically creates a usable IP network without manual operator intervention or special configuration servers, and other similar techniques may be used. Given an intelligent network system, multiple sources may reside on the IP network as the speakers. This allows multiple sources to directly drive the speakers without routing sound through a "master" audio source (e.g. traditional A/V receiver). If another source attempts to address the speakers, communications is performed between all sources to determine which source is currently "active", whether being active is necessary, and whether control can be transitioned to a new sound source. Sources may be pre-assigned a priority during manufacturing based on their classification, for example, a telecommunications source may have a higher priority than an entertainment source. In multi-room environment, such as a typical home environment, all speakers within the overall environment may reside on a single network, but may not need to be addressed simultaneously. During setup and auto-configuration, the sound level provided back over interconnect 1008 can be used to determine which speakers are located in the same physical space. Once this information is determined, the speakers may be grouped into clusters. In this case, cluster IDs can be assigned and made part of the driver definitions. The cluster ID is sent to each speaker, and each cluster can be addressed simultaneously by the sound source 1002.

As shown in FIG. 10, an optional power signal can be transmitted over the bi-directional interconnection. Speakers may either be passive (requiring external power from the sound source) or active (requiring power from an electrical outlet). If the speaker system consists of active speakers without wireless support, the input to the speaker consists of an IEEE 802.3 compliant wired Ethernet input. If the speaker system consists of active speakers with wireless support, the input to the speaker consists of an IEEE 802.11 compliant wireless Ethernet input, or alternatively, a wireless standard specified by the WISA organization. Passive speakers may be provided by appropriate power signals provided by the sound source directly.

System Configuration and Calibration

As shown in FIG. 4C, the functionality of the adaptive audio system includes a calibration function 462. This function is enabled by the microphone 1007 and interconnection 1008 links shown in FIG. 10. The function of the microphone component in the system 1000 is to measure the response of the individual drivers in the listening environment in order to derive an overall system response. Multiple microphone topologies can be used for this purpose including a single microphone or an array of microphones. The simplest case is where a single omni-directional measurement microphone positioned in the center of the listening environment is used to measure the response of each driver. If the listening environment and playback conditions warrant a more refined analysis, multiple microphones can be used instead. The most convenient location for multiple microphones is within the physical speaker cabinets of the particular speaker configuration that is used in the listening environment. Microphones installed in each enclosure allow the system to measure the response of each driver, at multiple positions in a listening environment. An alternative to this topology is to use multiple omni-directional measurement microphones positioned in likely listener locations in the listening environment.

Figure 11:
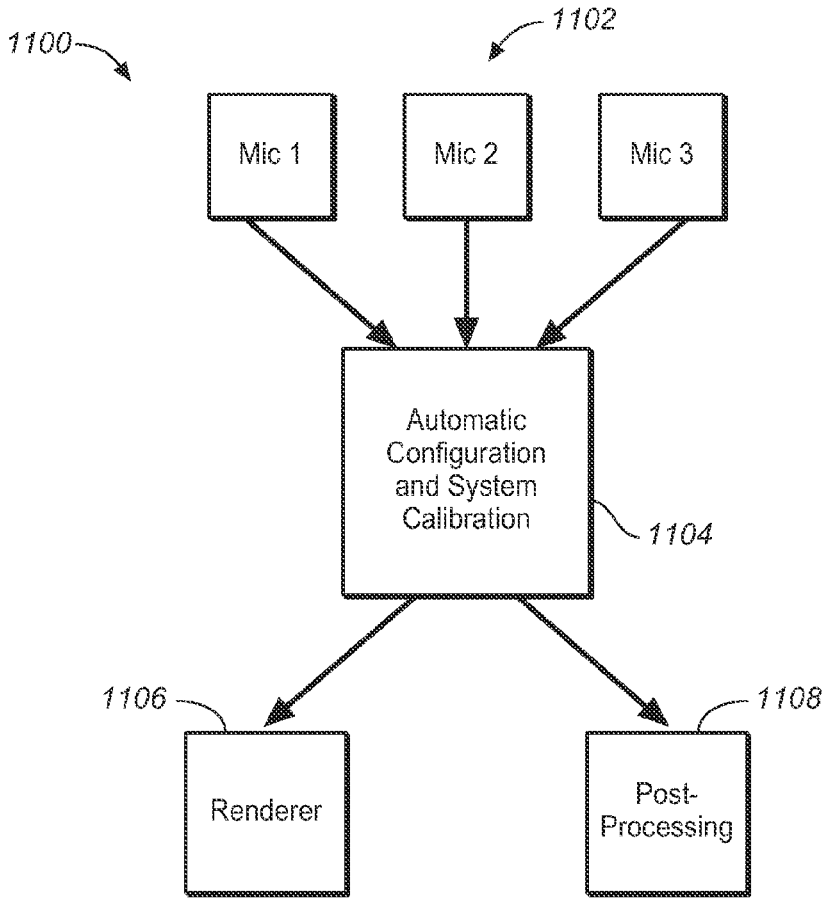
FIG. 11 illustrates an automatic configuration and system calibration process for use in an adaptive audio system, under an embodiment.

The microphone(s) are used to enable the automatic configuration and calibration of the renderer and post-processing algorithms. In the adaptive audio system, the renderer is responsible for converting a hybrid object and channel-based audio stream into individual audio signals designated for specific addressable drivers, within one or more physical speakers. The post-processing component may include: delay, equalization, gain, speaker virtualization, and upmixing. The speaker configuration represents often critical information that the renderer component can use to convert a hybrid object and channel-based audio stream into individual per-driver audio signals to provide optimum playback of audio content. System configuration information includes: (1) the number of physical speakers in the system, (2) the number individually addressable drivers in each speaker, and (3) the position and direction of each individually addressable driver, relative to the listening environment geometry. Other characteristics are also possible. FIG. 11 illustrates the function of an automatic configuration and system calibration component, under an embodiment. As shown in diagram 1100, an array 1102 of one or more microphones provides acoustic information to the configuration and calibration component 1104. This acoustic information captures certain relevant characteristics of the listening environment. The configuration and calibration component 1104 then provides this information to the renderer 1106 and any relevant post-processing components 1108 so that the audio signals that are ultimately sent to the speakers are adjusted and optimized for the listening environment.

The number of physical speakers in the system and the number of individually addressable drivers in each speaker are the physical speaker properties. These properties are transmitted directly from the speakers via the bi-directional interconnect 456 to the renderer 454. The renderer and speakers use a common discovery protocol, so that when speakers are connected or disconnected from the system, the render is notified of the change, and can re-configure the system accordingly.

The geometry (size and shape) of the listening environment is a necessary item of information in the configuration and calibration process. The geometry can be determined in a number of different ways. In a manual configuration mode, the width, length and height of the minimum bounding cube for the listening environment are entered into the system by the listener or technician through a user interface that provides input to the renderer or other processing unit within the adaptive audio system. Various different user interface techniques and tools may be used for this purpose. For example, the listening environment geometry can be sent to the renderer by a program that automatically maps or traces the geometry of the listening environment. Such a system may use a combination of computer vision, sonar, and 3D laser-based physical mapping.

The renderer uses the position of the speakers within the listening environment geometry to derive the audio signals for each individually addressable driver, including both direct and reflected (upward-firing) drivers. The direct drivers are those that are aimed such that the majority of their dispersion pattern intersects the listening position before being diffused by one or more reflective surfaces (such as a floor, wall or ceiling). The reflected drivers are those that are aimed such that the majority of their dispersion patterns are reflected prior to intersecting the listening position such as illustrated in FIG. 6. If a system is in a manual configuration mode, the 3D coordinates for each direct driver may be entered into the system through a UI. For the reflected drivers, the 3D coordinates of the primary reflection are entered into the UI. Lasers or similar techniques may be used to visualize the dispersion pattern of the diffuse drivers onto the surfaces of the listening environment, so the 3D coordinates can be measured and manually entered into the system.

Driver position and aiming is typically performed using manual or automatic techniques. In some cases, inertial sensors may be incorporated into each speaker. In this mode, the center speaker is designated as the "master" and its compass measurement is considered as the reference. The other speakers then transmit the dispersion patterns and compass positions for each off their individually addressable drivers. Coupled with the listening environment geometry, the difference between the reference angle of the center speaker and each addition driver provides enough information for the system to automatically determine if a driver is direct or reflected.

The speaker position configuration may be fully automated if a 3D positional (i.e., Ambisonic) microphone is used. In this mode, the system sends a test signal to each driver and records the response. Depending on the microphone type, the signals may need to be transformed into an x, y, z representation. These signals are analyzed to find the x, y, and z components of the dominant first arrival. Coupled with the listening environment geometry, this usually provides enough information for the system to automatically set the 3D coordinates for all speaker positions, direct or reflected. Depending on the listening environment geometry, a hybrid combination of the three described methods for configuring the speaker coordinates may be more effective than using just one technique alone.

Figure 12:
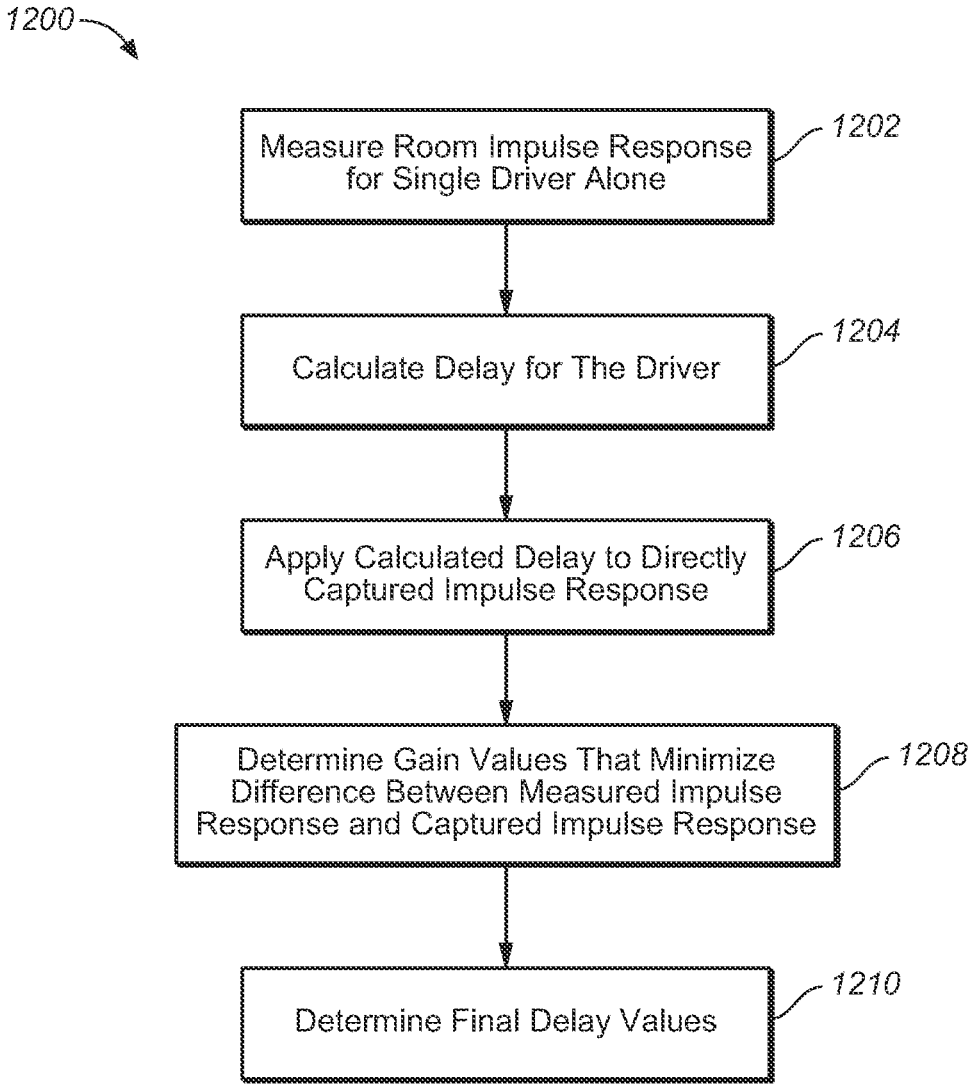
FIG. 12 is a flow diagram illustrating process steps for a calibration method used in an adaptive audio system, under an embodiment.

Speaker configuration information is one component required to configure the renderer. Speaker calibration information is also necessary to configure the post-processing chain: delay, equalization, and gain. FIG. 12 is a flowchart illustrating the process steps of performing automatic speaker calibration using a single microphone, under an embodiment. In this mode, the delay, equalization, and gain are automatically calculated by the system using a single omni-directional measurement microphone located in the middle of the listening position. As shown in diagram 1200, the process begins by measuring the room impulse response for each single driver alone, block 1202. The delay for each driver is then calculated by finding the offset of peak of the cross-correlation of the acoustic impulse response (captured with the microphone) with directly captured electrical impulse response, block 1204. In block 1206, the calculated delay is applied to the directly captured (reference) impulse response. The process then determines the wideband and per-band gain values that, when applied to measured impulse response, result in the minimum difference between it and the directly capture (reference) impulse response, block 1208. This can be done by taking the windowed FFT of the measured and reference impulse response, calculating the per-bin magnitude ratios between the two signals, applying a median filter to the per-bin magnitude ratios, calculating per-band gain values by averaging the gains for all of the bins that fall completely within a band, calculating a wide-band gain by taking the average of all per-band gains, subtract the wide-band gain from the per-band gains, and applying the small room X curve (−2 dB/octave above 2 kHz). Once the gain values are determined in block 1208, the process determines the final delay values by subtracting the minimum delay from the others, such that at least once driver in the system will always have zero additional delay, block 1210.

In the case of automatic calibration using multiple microphones, the delay, equalization, and gain are automatically calculated by the system using multiple omni-directional measurement microphones. The process is substantially identical to the single microphone technique, accept that it is repeated for each of the microphones, and the results are averaged.

Alternative Applications

Figure 13:
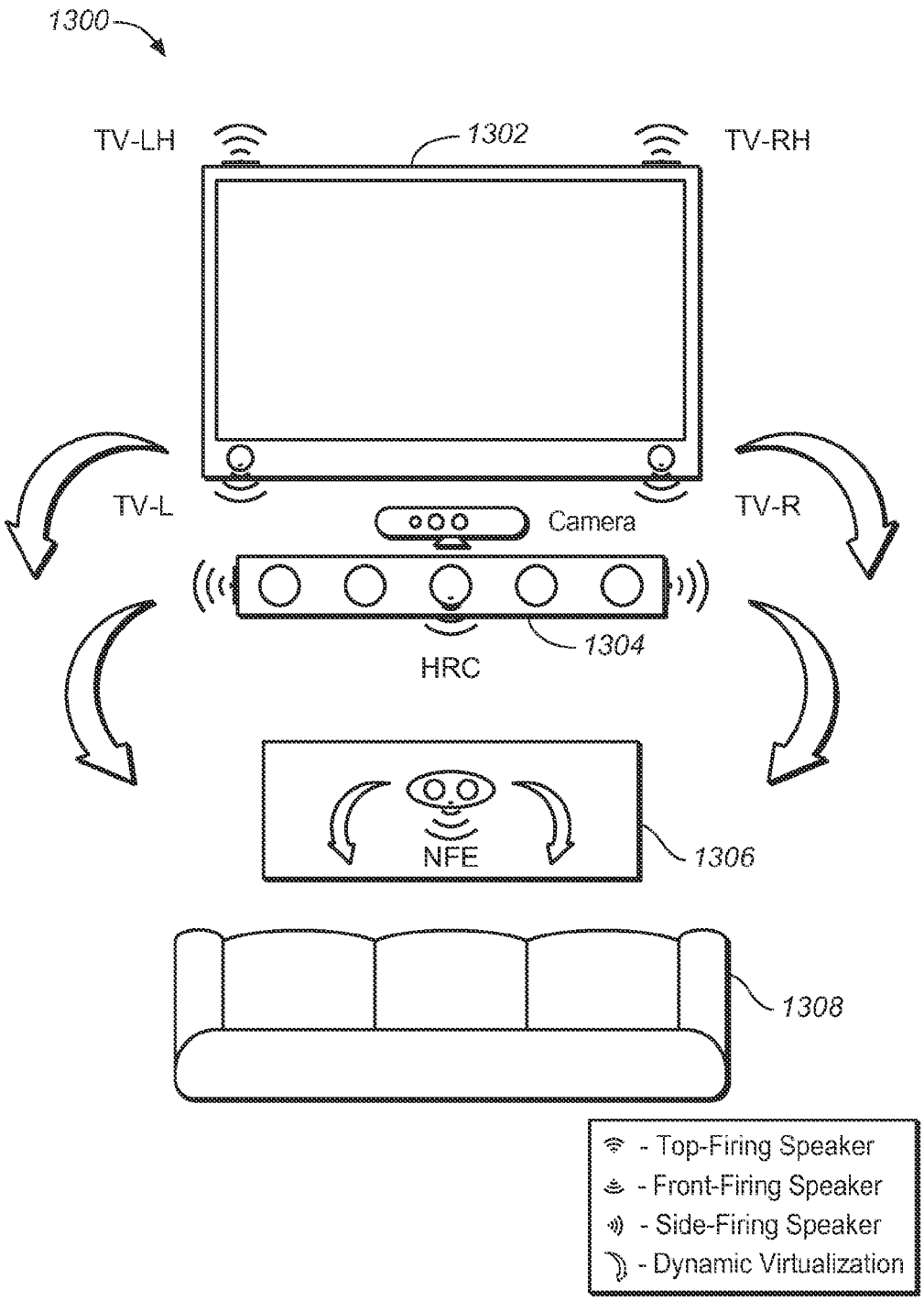
FIG. 13 illustrates the use of an adaptive audio system in an example television and soundbar use case.

Instead of implementing an adaptive audio system in an entire listening environment or theater, it is possible to implements aspects of the adaptive audio system in more localized applications, such as televisions, computers, game consoles, or similar devices. This case effectively relies on speakers that are arrayed in a flat plane corresponding to the viewing screen or monitor surface. FIG. 13 illustrates the use of an adaptive audio system in an example television and soundbar use case. In general, the television use case provides challenges to creating an immersive audio experience based on the often reduced quality of equipment (TV speakers, soundbar speakers, etc.) and speaker locations/configuration(s), which may be limited in terms of spatial resolution (i.e. no surround or back speakers). System 1300 of FIG. 13 includes speakers in the standard television left and right locations (TV-L and TV-R) as well as left and right upward-firing drivers (TV-LH and TV-RH). The television 1302 may also include a soundbar 1304 or speakers in some sort of height array. In general, the size and quality of television speakers are reduced due to cost constraints and design choices as compared to standalone or home theater speakers. The use of dynamic virtualization, however, can help to overcome these deficiencies. In FIG. 13, the dynamic virtualization effect is illustrated for the TV-L and TV-R speakers so that people in a specific listening position 1308 would hear horizontal elements associated with appropriate audio objects individually rendered in the horizontal plane. Additionally, the height elements associated with appropriate audio objects will be rendered correctly through reflected audio transmitted by the LH and RH drivers. The use of stereo virtualization in the television L and R speakers is similar to the L and R home theater speakers where a potentially immersive dynamic speaker virtualization user experience may be possible through the dynamic control of the speaker virtualization algorithms parameters based on object spatial information provided by the adaptive audio content. This dynamic virtualization may be used for creating the perception of objects moving along the sides on the listening environment.

The television environment may also include an HRC speaker as shown within soundbar 1304. Such an HRC speaker may be a steerable unit that allows panning through the HRC array. There may be benefits (particularly for larger screens) by having a front firing center channel array with individually addressable speakers that allow discrete pans of audio objects through the array that match the movement of video objects on the screen. This speaker is also shown to have side-firing speakers. These could be activated and used if the speaker is used as a soundbar so that the side-firing drivers provide more immersion due to the lack of surround or back speakers. The dynamic virtualization concept is also shown for the HRC/Soundbar speaker. The dynamic virtualization is shown for the L and R speakers on the farthest sides of the front firing speaker array. Again, this could be used for creating the perception of objects moving along the sides on the listening environment. This modified center speaker could also include more speakers and implement a steerable sound beam with separately controlled sound zones. Also shown in the example implementation of FIG. 13 is a NFE speaker 1306 located in front of the main listening location 1308. The inclusion of the NFE speaker may provide greater envelopment provided by the adaptive audio system by moving sound away from the front of the listening environment and nearer to the listener.

With respect to headphone rendering, the adaptive audio system maintains the creator's original intent by matching HRTFs to the spatial position. When audio is reproduced over headphones, binaural spatial virtualization can be achieved by the application of a Head Related Transfer Function (HRTF), which processes the audio, and add perceptual cues that create the perception of the audio being played in three-dimensional space and not over standard stereo headphones. The accuracy of the spatial reproduction is dependent on the selection of the appropriate HRTF which can vary based on several factors, including the spatial position of the audio channels or objects being rendered. Using the spatial information provided by the adaptive audio system can result in the selection of one—or a continuing varying number—of HRTFs representing 3D space to greatly improve the reproduction experience.

Figure 14:
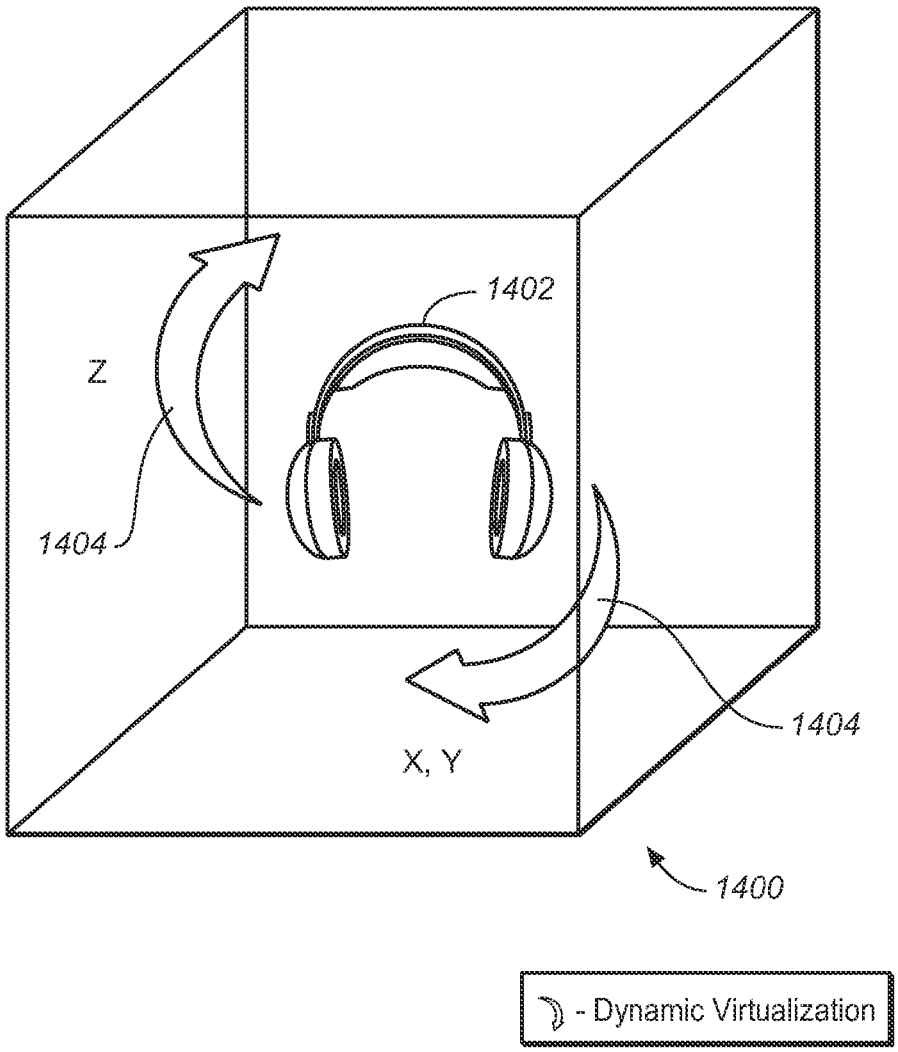
FIG. 14 illustrates a simplified representation of a three-dimensional binaural headphone virtualization in an adaptive audio system, under an embodiment.

The system also facilitates adding guided, three-dimensional binaural rendering and virtualization. Similar to the case for spatial rendering, using new and modified speaker types and locations, it is possible through the use of three-dimensional HRTFs to create cues to simulate the sound of audio coming from both the horizontal plane and the vertical axis. Previous audio formats that provide only channel and fixed speaker location information rendering have been more limited. With the adaptive audio format information, a binaural, three-dimensional rendering headphone system has detailed and useful information that can be used to direct which elements of the audio are suitable to be rendering in both the horizontal and vertical planes. Some content may rely on the use of overhead speakers to provide a greater sense of envelopment. These audio objects and information could be used for binaural rendering that is perceived to be above the listener's head when using headphones. FIG. 14 illustrates a simplified representation of a three-dimensional binaural headphone virtualization experience for use in an adaptive audio system, under an embodiment. As shown in FIG. 14, a headphone set 1402 used to reproduce audio from an adaptive audio system includes audio signals 1404 in the standard x, y plane as well as in the z-plane so that height associated with certain audio objects or sounds is played back so that they sound like they originate above or below the x, y originated sounds.

Metadata Definitions

In an embodiment, the adaptive audio system includes components that generate metadata from the original spatial audio format. The methods and components of system 300 comprise an audio rendering system configured to process one or more bitstreams containing both conventional channel-based audio elements and audio object coding elements. A new extension layer containing the audio object coding elements is defined and added to either one of the channel-based audio codec bitstream or the audio object bitstream. This approach enables bitstreams, which include the extension layer to be processed by renderers for use with existing speaker and driver designs or next generation speakers utilizing individually addressable drivers and driver definitions. The spatial audio content from the spatial audio processor comprises audio objects, channels, and position metadata. When an object is rendered, it is assigned to one or more speakers according to the position metadata, and the location of the playback speakers. Additional metadata may be associated with the object to alter the playback location or otherwise limit the speakers that are to be used for playback. Metadata is generated in the audio workstation in response to the engineer's mixing inputs to provide rendering queues that control spatial parameters (e.g., position, velocity, intensity, timbre, etc.) and specify which driver(s) or speaker(s) in the listening environment play respective sounds during exhibition. The metadata is associated with the respective audio data in the workstation for packaging and transport by spatial audio processor.

FIG. 15 is a table illustrating certain metadata definitions for use in an adaptive audio system for listening environments, under an embodiment. As shown in Table 1500, the metadata definitions include: audio content type, driver definitions (number, characteristics, position, projection angle), controls signals for active steering/tuning, and calibration information including room and speaker information.

Features and Capabilities

As stated above, the adaptive audio ecosystem allows the content creator to embed the spatial intent of the mix (position, size, velocity, etc.) within the bitstream via metadata. This allows an incredible amount of flexibility in the spatial reproduction of audio. From a spatial rendering standpoint, the adaptive audio format enables the content creator to adapt the mix to the exact position of the speakers in the listening environment to avoid spatial distortion caused by the geometry of the playback system not being identical to the authoring system. In current audio reproduction systems where only audio for a speaker channel is sent, the intent of the content creator is unknown for locations in the listening environment other than fixed speaker locations. Under the current channel/speaker paradigm the only information that is known is that a specific audio channel should be sent to a specific speaker that has a predefined location in a listening environment. In the adaptive audio system, using metadata conveyed through the creation and distribution pipeline, the reproduction system can use this information to reproduce the content in a manner that matches the original intent of the content creator. For example, the relationship between speakers is known for different audio objects. By providing the spatial location for an audio object, the intention of the content creator is known and this can be "mapped" onto the speaker configuration, including their location. With a dynamic rendering audio rendering system, this rendering can be updated and improved by adding additional speakers.

The system also enables adding guided, three-dimensional spatial rendering. There have been many attempts to create a more immersive audio rendering experience through the use of new speaker designs and configurations. These include the use of bi-pole and di-pole speakers, side-firing, rear-firing and upward-firing drivers. With previous channel and fixed speaker location systems, determining which elements of audio should be sent to these modified speakers is relatively difficult. Using an adaptive audio format, a rendering system has detailed and useful information of which elements of the audio (objects or otherwise) are suitable to be sent to new speaker configurations. That is, the system allows for control over which audio signals are sent to the front-firing drivers and which are sent to the upward-firing drivers. For example, the adaptive audio cinema content relies heavily on the use of overhead speakers to provide a greater sense of envelopment. These audio objects and information may be sent to upward-firing drivers to provide reflected audio in the listening environment to create a similar effect.

The system also allows for adapting the mix to the exact hardware configuration of the reproduction system. There exist many different possible speaker types and configurations in rendering equipment such as televisions, home theaters, soundbars, portable music player docks, and so on. When these systems are sent channel specific audio information (i.e., left and right channel or standard multichannel audio) the system must process the audio to appropriately match the capabilities of the rendering equipment. A typical example is when standard stereo (left, right) audio is sent to a soundbar, which has more than two speakers. In current audio systems where only audio for a speaker channel is sent, the intent of the content creator is unknown and a more immersive audio experience made possible by the enhanced equipment must be created by algorithms that make assumptions of how to modify the audio for reproduction on the hardware. An example of this is the use of PLII, PLII-z, or Next Generation Surround to "up-mix" channel-based audio to more speakers than the original number of channel feeds. With the adaptive audio system, using metadata conveyed throughout the creation and distribution pipeline, a reproduction system can use this information to reproduce the content in a manner that more closely matches the original intent of the content creator. For example, some soundbars have side-firing speakers to create a sense of envelopment. With adaptive audio, the spatial information and the content type information (i.e., dialog, music, ambient effects, etc.) can be used by the soundbar when controlled by a rendering system such as a TV or A/V receiver to send only the appropriate audio to these side-firing speakers.

The spatial information conveyed by adaptive audio allows the dynamic rendering of content with an awareness of the location and type of speakers present. In addition information on the relationship of the listener or listeners to the audio reproduction equipment is now potentially available and may be used in rendering. Most gaming consoles include a camera accessory and intelligent image processing that can determine the position and identity of a person in the listening environment. This information may be used by an adaptive audio system to alter the rendering to more accurately convey the creative intent of the content creator based on the listener's position. For example, in nearly all cases, audio rendered for playback assumes the listener is located in an ideal "sweet spot" which is often equidistant from each speaker and the same position the sound mixer was located during content creation. However, many times people are not in this ideal position and their experience does not match the creative intent of the mixer. A typical example is when a listener is seated on the left side of the listening environment on a chair or couch. For this case, sound being reproduced from the nearer speakers on the left will be perceived as being louder and skewing the spatial perception of the audio mix to the left. By understanding the position of the listener, the system could adjust the rendering of the audio to lower the level of sound on the left speakers and raise the level of the right speakers to rebalance the audio mix and make it perceptually correct. Delaying the audio to compensate for the distance of the listener from the sweet spot is also possible. Listener position could be detected either through the use of a camera or a modified remote control with some built-in signaling that would signal listener position to the rendering system.

In addition to using standard speakers and speaker locations to address listening position it is also possible to use beam steering technologies to create sound field "zones" that vary depending on listener position and content. Audio beam forming uses an array of speakers (typically 8 to 16 horizontally spaced speakers) and use phase manipulation and processing to create a steerable sound beam. The beam forming speaker array allows the creation of audio zones where the audio is primarily audible that can be used to direct specific sounds or objects with selective processing to a specific spatial location. An obvious use case is to process the dialog in a soundtrack using a dialog enhancement post-processing algorithm and beam that audio object directly to a user that is hearing impaired.

Matrix Encoding and Spatial Upmixing

In some cases audio objects may be a desired component of adaptive audio content; however, based on bandwidth limitations, it may not be possible to send both channel/speaker audio and audio objects. In the past matrix encoding has been used to convey more audio information than is possible for a given distribution system. For example, this was the case in the early days of cinema where multi-channel audio was created by the sound mixers but the film formats only provided stereo audio. Matrix encoding was used to intelligently downmix the multi-channel audio to two stereo channels, which were then processed with certain algorithms to recreate a close approximation of the multi-channel mix from the stereo audio. Similarly, it is possible to intelligently downmix audio objects into the base speaker channels and through the use of adaptive audio metadata and sophisticated time and frequency sensitive next generation surround algorithms to extract the objects and correctly spatially render them with an adaptive audio rendering system.

Additionally, when there are bandwidth limitations of the transmission system for the audio (3G and 4G wireless applications for example) there is also benefit from transmitting spatially diverse multi-channel beds that are matrix encoded along with individual audio objects. One use case of such a transmission methodology would be for the transmission of a sports broadcast with two distinct audio beds and multiple audio objects. The audio beds could represent the multi-channel audio captured in two different teams bleacher sections and the audio objects could represent different announcers who may be sympathetic to one team or the other. Using standard coding a 5.1 representation of each bed along with two or more objects could exceed the bandwidth constraints of the transmission system. In this case, if each of the 5.1 beds were matrix encoded to a stereo signal, then two beds that were originally captured as 5.1 channels could be transmitted as two-channel bed 1, two-channel bed 2, object 1, and object 2 as only four channels of audio instead of 5.1+5.1+2 or 12.1 channels.

Position and Content Dependent Processing

The adaptive audio ecosystem allows the content creator to create individual audio objects and add information about the content that can be conveyed to the reproduction system. This allows a large amount of flexibility in the processing of audio prior to reproduction. Processing can be adapted to the position and type of object through dynamic control of speaker virtualization based on object position and size. Speaker virtualization refers to a method of processing audio such that a virtual speaker is perceived by a listener. This method is often used for stereo speaker reproduction when the source audio is multi-channel audio that includes surround speaker channel feeds. The virtual speaker processing modifies the surround speaker channel audio in such a way that when it is played back on stereo speakers, the surround audio elements are virtualized to the side and back of the listener as if there was a virtual speaker located there. Currently the location attributes of the virtual speaker location are static because the intended location of the surround speakers was fixed. However, with adaptive audio content, the spatial locations of different audio objects are dynamic and distinct (i.e. unique to each object). It is possible that post processing such as virtual speaker virtualization can now be controlled in a more informed way by dynamically controlling parameters such as speaker positional angle for each object and then combining the rendered outputs of several virtualized objects to create a more immersive audio experience that more closely represents the intent of the sound mixer.

In addition to the standard horizontal virtualization of audio objects, it is possible to use perceptual height cues that process fixed channel and dynamic object audio and get the perception of height reproduction of audio from a standard pair of stereo speakers in the normal, horizontal plane, location.

Certain effects or enhancement processes can be judiciously applied to appropriate types of audio content. For example, dialog enhancement may be applied to dialog objects only. Dialog enhancement refers to a method of processing audio that contains dialog such that the audibility and/or intelligibility of the dialog is increased and or improved. In many cases the audio processing that is applied to dialog is inappropriate for non-dialog audio content (i.e. music, ambient effects, etc.) and can result is an objectionable audible artifact. With adaptive audio, an audio object could contain only the dialog in a piece of content and can be labeled accordingly so that a rendering solution would selectively apply dialog enhancement to only the dialog content. In addition, if the audio object is only dialog (and not a mixture of dialog and other content, which is often the case) then the dialog enhancement processing can process dialog exclusively (thereby limiting any processing being performed on any other content).

Similarly audio response or equalization management can also be tailored to specific audio characteristics. For example, bass management (filtering, attenuation, gain) targeted at specific object based on their type. Bass management refers to selectively isolating and processing only the bass (or lower) frequencies in a particular piece of content. With current audio systems and delivery mechanisms this is a "blind" process that is applied to all of the audio. With adaptive audio, specific audio objects in which bass management is appropriate can be identified by metadata and the rendering processing applied appropriately.

The adaptive audio system also facilitates object-based dynamic range compression. Traditional audio tracks have the same duration as the content itself, while an audio object might occur for a limited amount of time in the content. The metadata associated with an object may contain level-related information about its average and peak signal amplitude, as well as its onset or attack time (particularly for transient material). This information would allow a compressor to better adapt its compression and time constants (attack, release, etc.) to better suit the content.

The system also facilitates automatic loudspeaker-room equalization. Loudspeaker and listening environment acoustics play a significant role in introducing audible coloration to the sound thereby impacting timbre of the reproduced sound. Furthermore, the acoustics are position-dependent due to listening environment reflections and loudspeaker-directivity variations and because of this variation the perceived timbre will vary significantly for different listening positions. An AutoEQ (automatic room equalization) function provided in the system helps mitigate some of these issues through automatic loudspeaker-room spectral measurement and equalization, automated time-delay compensation (which provides proper imaging and possibly least-squares based relative speaker location detection) and level setting, bass-redirection based on loudspeaker headroom capability, as well as optimal splicing of the main loudspeakers with the subwoofer(s). In a home theater or other listening environment, the adaptive audio system includes certain additional functions, such as: (1) automated target curve computation based on playback room-acoustics (which is considered an open-problem in research for equalization in domestic listening environments), (2) the influence of modal decay control using time-frequency analysis, (3) understanding the parameters derived from measurements that govern envelopment/spaciousness/source-width/intelligibility and controlling these to provide the best possible listening experience, (4) directional filtering incorporating head-models for matching timbre between front and "other" loudspeakers, and (5) detecting spatial positions of the loudspeakers in a discrete setup relative to the listener and spatial re-mapping (e.g., Summit wireless would be an example). The mismatch in timbre between loudspeakers is especially revealed on certain panned content between a front-anchor loudspeaker (e.g., center) and surround/back/wide/height loudspeakers.

Overall, the adaptive audio system also enables a compelling audio/video reproduction experience, particularly with larger screen sizes in a home environment, if the reproduced spatial location of some audio elements match image elements on the screen. An example is having the dialog in a film or television program spatially coincide with a person or character that is speaking on the screen. With normal speaker channel-based audio there is no easy method to determine where the dialog should be spatially positioned to match the location of the person or character on-screen. With the audio information available in an adaptive audio system, this type of audio/visual alignment could be easily achieved, even in home theater systems that are featuring ever larger size screens. The visual positional and audio spatial alignment could also be used for non-character/dialog objects such as cars, trucks, animation, and so on.

The adaptive audio ecosystem also allows for enhanced content management, by allowing a content creator to create individual audio objects and add information about the content that can be conveyed to the reproduction system. This allows a large amount of flexibility in the content management of audio. From a content management standpoint, adaptive audio enables various things such as changing the language of audio content by only replacing a dialog object to reduce content file size and/or reduce download time. Film, television and other entertainment programs are typically distributed internationally. This often requires that the language in the piece of content be changed depending on where it will be reproduced (French for films being shown in France, German for TV programs being shown in Germany, etc.). Today this often requires a completely independent audio soundtrack to be created, packaged, and distributed for each language. With the adaptive audio system and the inherent concept of audio objects, the dialog for a piece of content could an independent audio object. This allows the language of the content to be easily changed without updating or altering other elements of the audio soundtrack such as music, effects, etc. This would not only apply to foreign languages but also inappropriate language for certain audience, targeted advertising, etc.

Aspects of the audio environment of described herein represents the playback of the audio or audio/visual content through appropriate speakers and playback devices, and may represent any environment in which a listener is experiencing playback of the captured content, such as a cinema, concert hall, outdoor theater, a home or room, listening booth, car, game console, headphone or headset system, public address (PA) system, or any other playback environment. Although embodiments have been described primarily with respect to examples and implementations in a home theater environment in which the spatial audio content is associated with television content, it should be noted that embodiments might also be implemented in other systems. The spatial audio content comprising object-based audio and channel-based audio may be used in conjunction with any related content (associated audio, video, graphic, etc.), or it may constitute standalone audio content. The playback environment may be any appropriate listening environment from headphones or near field monitors to small or large rooms, cars, open air arenas, concert halls, and so on.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A system for rendering sound using reflected sound elements, comprising:

an array of audio drivers for distribution around a listening environment, wherein at least one driver of the array of audio drivers is an upward-firing driver, which is configured to project sound waves toward a ceiling of the listening environment for reflection to a listening area within the listening environment;

a renderer configured to receive and process a bitstream including audio streams and one or more metadata sets that are associated with each of the audio streams and that specify a playback location in the listening environment of audio objects in a respective audio stream, wherein the audio streams comprise one or more reflected audio streams and one or more direct audio streams, the renderer further configured to render one or more of the audio objects that should be rendered above a head of a listener at the listening area in the listening environment using an upward-firing driver and height information related to the one or more audio objects; and a playback component coupled to the renderer and configured to render the audio streams to a plurality of audio feeds corresponding to the array of audio drivers in accordance with the one or more metadata sets, and wherein the one or more reflected audio streams are transmitted to the at least one upward-firing driver; characterized in that the system performs signal processing to introduce perceptual height cues into the reflected audio streams fed to the at least one upward-firing driver, the perceptual height cues derived by at least partially removing from the reflected audio streams a first height cue for a physical speaker location in the listening environment and at least partially inserting in the reflected audio streams a second height cue for a reflected speaker location.

2. The system of claim 1 wherein each audio driver of the array of audio drivers is uniquely addressable according to a communication protocol used by the renderer and the playback component.

3. The system of claim 2 wherein the at least one audio driver comprises one of: a side-firing driver and an upward-firing driver, and wherein the at least one audio driver is further embodied in one of: a standalone driver within a speaker enclosure and a driver placed proximate one or more front firing drivers in a unitary speaker enclosure.

4. The system of claim 3 wherein the array of audio drivers comprises drivers that are distributed around the listening environment in accordance with a defined surround sound configuration.

5. The system of claim 4 wherein the listening environment comprises a home environment, and wherein the renderer and playback component comprise part of a home audio system, and further wherein the audio streams comprise audio content that includes at least one of cinema content transformed for playback in the home environment, television content, user generated content, computer game content, or music.

6. The system of claim 4 wherein a metadata set associated with the audio stream transmitted to the at least one driver defines one or more characteristics pertaining to the reflection.

7. The system of claim 6 wherein the metadata set supplements a base metadata set that includes metadata elements associated with an object-based stream of spatial audio information, and wherein the metadata elements for the object-based stream specify spatial parameters that control the playback of a corresponding object-based sound and comprise at least one of sound position, sound width, or sound velocity.

8. The system of claim 7 wherein the metadata set further includes metadata elements associated with a channel-based stream of the spatial audio information, and wherein the metadata elements associated with each channel-based stream comprise designations of surround-sound channels of the audio drivers in the defined surround-sound configuration.

9. The system of claim 6 wherein the at least one driver is associated with a microphone placed in the listening environment, the microphone configured to transmit configuration audio information encapsulating characteristics of the listening environment to a calibration component coupled to the renderer, and wherein the configuration audio information is used by the renderer to define or modify the metadata set associated with the audio stream transmitted to the at least one audio driver.

10. The system of claim 1 wherein the at least one driver comprises one of: a manually adjustable audio transducer within an enclosure that is adjustable with respect to a sound firing angle relative to a floor plane of the listening environment and an electrically controllable audio transducer within an enclosure that is automatically adjustable with respect to the sound firing angle.

* * * * *